US006250115B1

(12) United States Patent
Suzuki

(10) Patent No.: US 6,250,115 B1
(45) Date of Patent: Jun. 26, 2001

(54) METHOD FOR CREATING KNITTED GARMENTS AND PATTERNS THEREFOR

(75) Inventor: Yasuko Suzuki, 34-2, Momoi 1-chome, Suginami-ku, Tokyo (JP)

(73) Assignees: Yasuko Suzuki; Yoshikazu Suzuki, both of Tokyo (JP)

( * ) Notice: Subject to any disclaimer, the term of this patent is extended or adjusted under 35 U.S.C. 154(b) by 0 days.

(21) Appl. No.: 09/028,455

(22) Filed: Feb. 24, 1998

(51) Int. Cl.[7] ..... D04B 39/00
(52) U.S. Cl. ..... 66/171; 66/170; 66/169 R
(58) Field of Search ..... 66/76, 176, 171, 66/64, 175, 189, 65; 33/2 R, 4, 5, 11, 12, 17 R; 2/169

(56) References Cited

U.S. PATENT DOCUMENTS

| | | | | |
|---|---|---|---|---|
| 2,121,168 | | 6/1938 | Hibshman . | |
| 2,782,619 | | 2/1957 | Bialostok . | |
| 3,057,178 | * | 10/1962 | Konklin . | |
| 3,605,452 | * | 9/1971 | Carter et al. | 66/176 |
| 3,635,051 | * | 1/1972 | Betts et al. | 66/128 |
| 4,473,908 | | 10/1984 | Knecht . | |
| 5,289,701 | * | 3/1994 | Mitsumoto et al. | 66/76 |
| 5,388,430 | * | 2/1995 | Essig | 66/176 |

FOREIGN PATENT DOCUMENTS

| | | |
|---|---|---|
| 269 13 060 | 10/1996 | (DE) . |
| 52-150150 | 12/1977 | (JP) . |
| 4-289248 | 10/1992 | (JP) . |

* cited by examiner

*Primary Examiner*—Danny Worrell
(74) *Attorney, Agent, or Firm*—Pillsbury Winthrop LLP

(57) ABSTRACT

The present invention relates to a method for creating knitted garments comprising steps of forming an entirely deployed pattern having a deployed shape which can be obtained by flattening an entire predetermined three-dimensional design of a garment to be knitted, dividing the entirely deployed pattern into a plurality of divided areas to form pattern pieces, creating knitted pieces which conform to each shape of the pattern pieces, and forming the predetermined design of garments by joining the knitted pieces to each other based on an arrangement of the divided areas.

According to the present invention, since the entirely deployed pattern is formed based on the three-dimensional design which fits to the contours of the wearer, the knitted garment snugly fits and allows easy movement of the body. Further, since the area enclosed by the complicated outline of the entirely deployed pattern is divided into pattern pieces having simple shapes based on which beginners can easily create the knitted pieces, it enables to simplify a knitting operation.

19 Claims, 24 Drawing Sheets

METHOD FOR CREATING KNITTED GARMENTS AND PATTERNS THEREFOR

BACKGROUND OF THE INVENTION

The present invention relates to a method for creating knitted garments, and, more particularly, to a method for creating knitted garments by using a knitting machine, double pointed needles, knitting needles, a crochet hook, or the like.

DESCRIPTION OF THE PRIOR ART

Creating knitted garments, for example, sweaters, dresses or the like using a portable knitting machine, knitting needles, a hook or a crochet needle is a popular hobby.

A conventional method for creating knitted garments shall be described by explaining the case where a sweater with sleeves is created. In general, a design of a knitted garment to be made is predetermined as a first step. Then, three patterns consisting of a front bodice pattern, a back bodice pattern, and a sleeve pattern are formed by separating the predetermined design along armhole lines, under sleeve lines, shoulder lines, and side lines. Based on the patterns, flat knitted pieces of a front bodice section, a back bodice section and sleeve sections are created. Then, the knitted pieces are joined to each other to form the knitted garment.

Further, there is another way of forming garments by knitting a large number of medallions of the same shape and joining them to each other as a patchwork. Even in such a case, garments are made based on the above-mentioned three patterns. More specifically, first, a large number of flat medallions of the same shape, for example, a square, hexagon, or the like are knitted. Then, the medallions are disposed in a geometrically arranged design according to each of the three patterns and are joined to each other to form a front bodice section, a back bodice section and sleeve sections. Finally, these sections are joined to each other to form a sweater.

The reason for separating the predetermined design of the knitted garments along the above-mentioned lines in the conventional way is because it is a practical and convenient way of flattening the three-dimentional predetermined design of the knitted garment. That is, by deploying the three-dimensional design in such a manner, the smallest possible number of patterns is required. Further, the shape of each pattern becomes relatively simple, thus enabling a knitting operation of the knitted sections based on the patterns to be simplified. However, according to the conventional way, it is difficult to form curved three-dimensional garment silhouettes which fit the contours of a wearer's body, for example, round portions of the shoulders, breast, waist and elbows. Although knitted garments are stretchable, it is more functional and comfortable for the wearer if they snugly fit the contours of the body, and especially if the portions of the garments which need to allow for constant movement, e.g., the elbow portions, fit snugly. Further, in order to satisfy a demand for high fashionability, a designer may want to design garment silhouettes having more feminine-like curves.

SUMMARY OF THE INVENTION

It is, therefore, an object of the present invention to provide a method for creating knitted garments which enables the forming of three-dimensional knitted garments which fit the contours of the body while still allowing a knitting operation to be easy even for beginners.

In the conventional way, the above-mentioned three patterns which are deployed in the same manner are generally used to create knitted garments, whereas, in the present invention, a three-dimensional curved silhouette of an entire knitted garment is designed without any design restrictions, and then the entire design of the predetermined shape is flattened to form an entirely deployed pattern.

Further, in the conventional way of creating the knitted garments, a single knitted piece is made based on the three patterns. In the present invention, an area enclosed by an outline of the entirely deployed pattern is further divided into a plurality of divided areas having simple shapes based on which knitted pieces can be easily formed.

This enables the simplification of knitting operations even if the outline of the pattern is very complicated.

The above and other objects of the present invention can be accomplished by a method for creating knitted garments, comprising steps of: forming an entirely deployed pattern having a deployed shape which can be obtained by flattening an entire predetermined three-dimensional design of a garment to be knitted; dividing the entirely deployed pattern into a plurality of divided areas to form pattern pieces; creating knitted pieces which conform to each shape of the pattern pieces; and forming the predetermined design of the garment by joining the knitted pieces to each other based on the divided arrangement of the divided areas.

In the case where knitted garments are created in accordance with the present invention, a three-dimensional design of a knitted garment to be created is predetermined taking a curved profile of the body into a consideration. Then, an entirely deployed pattern having a shape which can be obtained by deployment of the entire predetermined shape including a front bodice portion, a back bodice portion, sleeve portions, cuffs portions, collar portion, etc., by cutting and clipping at some locations is formed. The locations to be cut and clipped shall be determined according to the design of the garment. Further, an inner area enclosed by an outline of the entirely deployed pattern is divided into a plurality of divided areas based on which a knitter can easily create knitted pieces to form a plurality of pattern pieces. Subsequently, knitted pieces are created which conforms with the shapes of the pattern pieces. The knitted pieces are joined to each other to form the garment.

According to the present invention, since the entirely deployed pattern is formed based on the three-dimensional design which fits the contours of the body of the wearer, the knitted garment fits snugly while also allowing easy movement. Further, since the area enclosed by the complicated outline of the entirely deployed pattern is divided into pattern pieces having simple shapes based on which beginners can easily create the knitted pieces, a knitting operation can be simplified. By simply joining the knitted pieces to each other, or seaming them together in accordance with an easy method, a knitted garment having a curved three-dimensional shape which fits the body can be formed. Further, by dividing the entire knitted garment into a plurality of divided areas and knitted pieces which are knitted in different directions and connected to each other based on an arrangement of the divided areas, distortion of the knitted pieces caused by strands of yarn can be compensated or corrected, which results in the entire shape of the knitted garment being without distortions.

The above and other objects and features of the present invention will become apparent from the following description made with reference to the accompanying drawings.

DESCRIPTION OF THE PREFERRED EMBODIMENTS

Preferred embodiments of the present invention shall be explained in the case where a sweater is knitted as an example of knitted garments.

Figure 1:
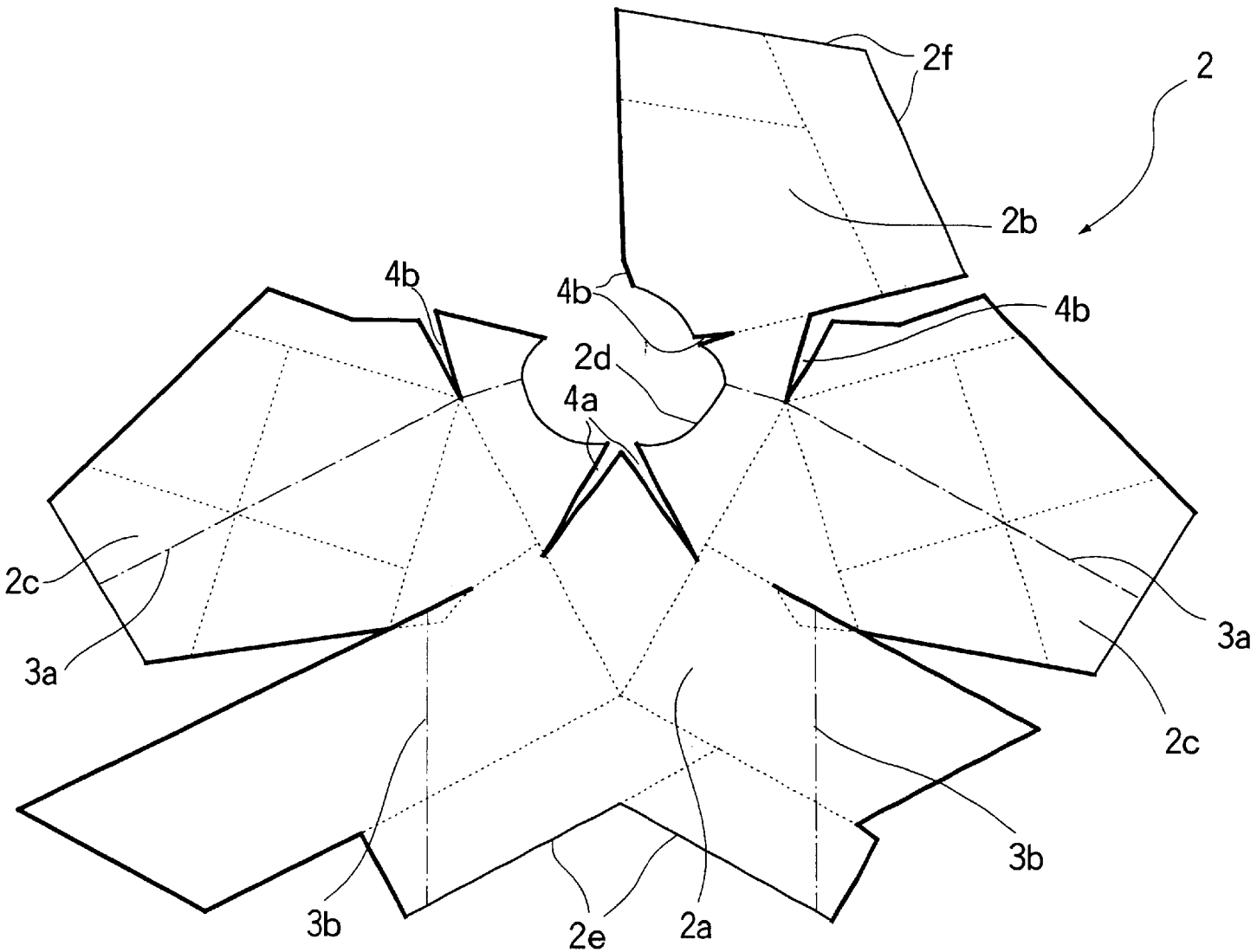
FIG. 1 shows a first entirely deployed pattern and pattern pieces thereof in accordance with a first embodiment.
Figure 2:
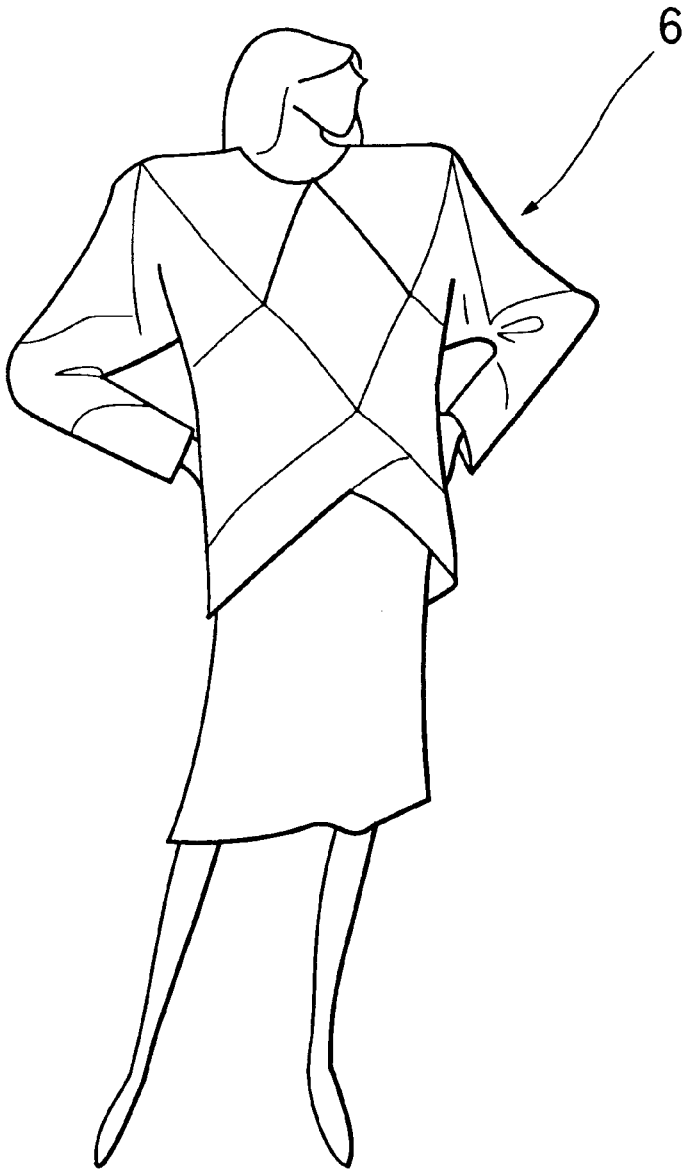
FIG. 2 shows a first sweater knitted according to the first entirely deployed pattern shown in FIG. 1.

FIG. 1 shows a first entirely deployed pattern and pattern pieces thereof in accordance with a first embodiment. FIG. 2 shows a first sweater knitted according to the first entirely deployed pattern shown in FIG. 1.

To knit a sweater, first of all, a silhouette of the sweater to be knitted, i.e., a profile of the sweater, is designed. In the first embodiment, a shape of a collarless long sleeve sweater including a front bodice portion, a back bodice portion, and long sleeve portions is predetermined. More specifically, the first predetermined shape has the front bodice portion including a round neckline, a lower edge which is symmetrically inclined in an upward direction with respect to a center front line of the front bodice portion, and a breast portion of a three-dimensional shape having fullness. Further, it has the back bodice portion including a lower edge which is symmetrically inclined in a downward direction with respect to a center back line of the back bodice portion, and a round back portion of a three-dimensional shape.

Then, as shown in FIG. 1, a first entirely deployed pattern 2 (the outline shown in solid lines in FIG. 1 having a shape which can be obtained by flattening the entire first predetermined shape) is formed out of a material such as paper, cardboard, or the like. Among the solid lines showing the outline of the pattern 2, thick lines show the portions where the first predetermined shape is cut to be deployed, and thin lines show a neckline, sleeve edges and the lower edges of the front and back bodice portions. Briefly explaining details of the first entirely deployed pattern 2, the front bodice portion is indicated at 2*a*, the back bodice portion at 2*b*, sleeve portions at 2*c*, the round neckline at 2*d*, the lower edge of the front bodice portion at 2*e*, and the lower edge of the back bodice portion at 2*f*. Further, one-dot chain lines 3*a* show folding lines of the sleeve portions and shoulder portions and one-dot chain lines 3*b* show folding lines of the side portions. Furthermore, darts or clippings indicated at 4*a* are for flattening the fullness of the breast portions of the front bodice portions 2*a* and those indicated at 4*b* are for flattening the round back portion of the back bodice portion 2*b*.

Then an inner area enclosed by the complex outline of the first entirely deployed pattern 2 is divided into a plurality of divided areas. It shall be determined how to divide the outline of the first entirely deployed pattern 2 so that the divided areas have simple shapes based on which knitted pieces can be easily created by observing the outline. How the pattern should be divided can also be determined based on the ornamental design of a sweater, i.e. colorwork of the sweater, as described in detail hereafter. Since the first entirely deployed pattern 2 according to the first embodiment has the outline with many corners, the above is the most practical way to divide the entire area thereof into a plurality of divided areas, each having a rectangular shape so that a knitter can easily create the knitted pieces as explained hereafter. Therefore, the first entirely deployed pattern 2 is divided into a plurality of divided areas, each having a shape of a rectangle, square, diamond, or trapezoid, (hereinafter, inclusively called a "rectangle" or "rectangular shape") as shown by dotted lines in FIG. 1. Each of the divided areas defines a pattern piece. It is to be noted that each of the pattern pieces can be individually separated as a template or the entirely deployed pattern 2 may be kept in one piece where knitted pieces are created based on the shapes of the pattern pieces shown by the dotted lines.

Subsequently, the knitted pieces are created based on each of the pattern pieces. Since a rectangular knitted piece has four straight sides, it can be easily knitted by the knitter. When all of the knitted pieces have been created, they are arranged and aligned in accordance with the arrangement of the divided areas of the first entirely deployed pattern 2 shown in FIG. 1 and are then joined to each other to form a joined knitted cloth. Further, the joined knitted cloth is folded along the one-dot chain lines shown in FIG. 1 in the same direction and the edges shown by the thick solid lines in FIG. 1 are aligned and joined to each other to form the first predetermined shape. The darts shown by the reference numerals 4*a* and 4*b* are joined to form the round three-dimensional shape. If each knitted piece is knitted out of yarns of different colors, or knitted in different texture patterns with different kinds of stitches, including knit and purl stitches, or the like, the first sweater 6 having rectangular ornamental design as shown in FIG. 2 can be obtained.

Another embodiment according to the present invention shall be explained hereafter. Among the steps described hereabove, designing a predetermined shape of a sweater, forming an entirely deployed pattern by flattening the predetermined shape, dividing the entirely deployed pattern into divided area to form pattern pieces, creating knitted pieces based on each of the pattern pieces and joining the knitted pieces to each other to form the sweater of the predetermined shape, are the same as the steps of the first embodiment. Therefore, in the following embodiments, only the differences between the first embodiment and the other embodiments, i.e., how the predetermined shape is flattened to form an entirely deployed pattern and how the entirely deployed pattern is divided into divided areas to form pattern pieces, shall be explained.

Figure 3:
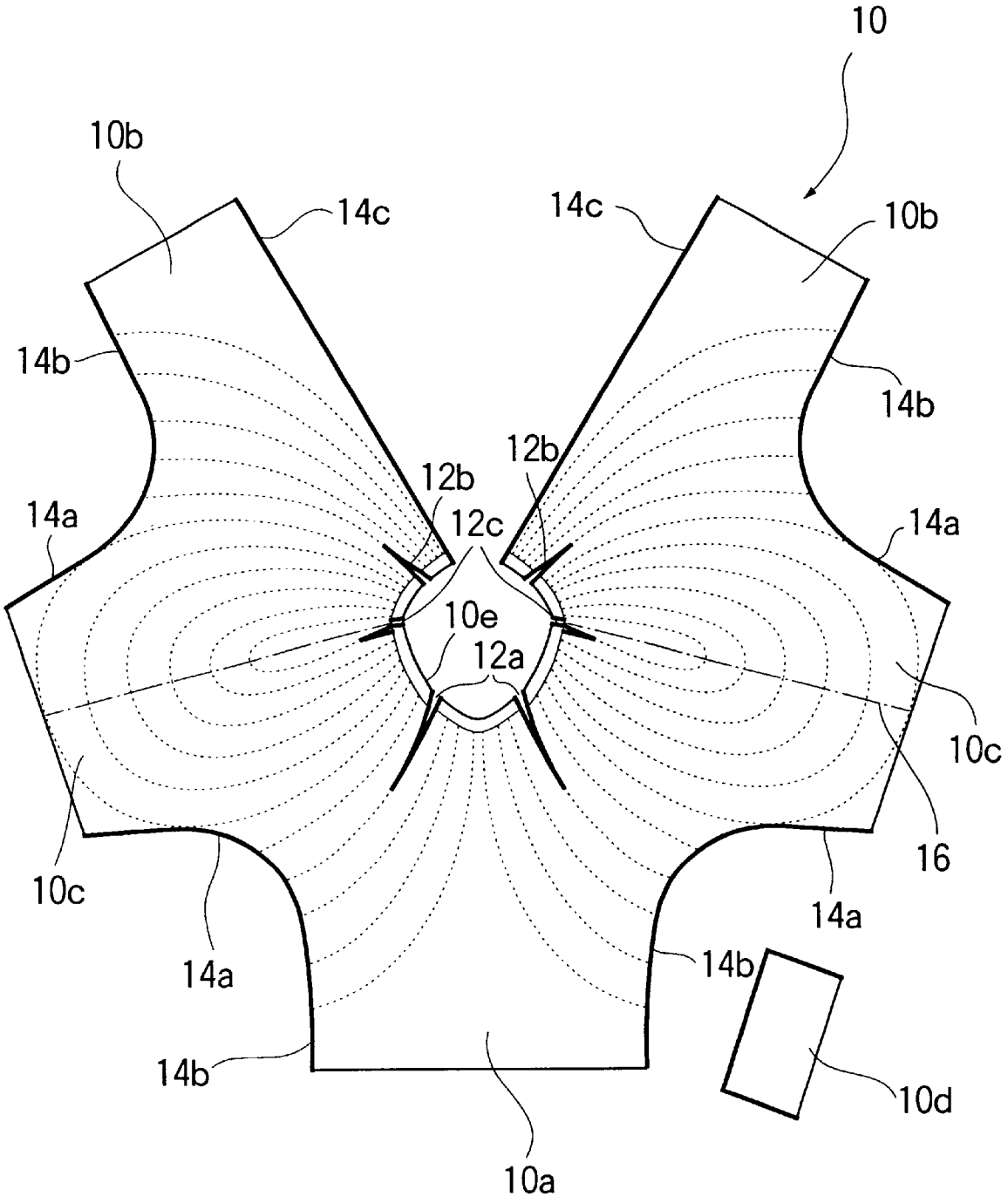
FIG. 3 shows a second entirely deployed pattern and pattern pieces thereof in accordance with a first embodiment.
Figure 4:
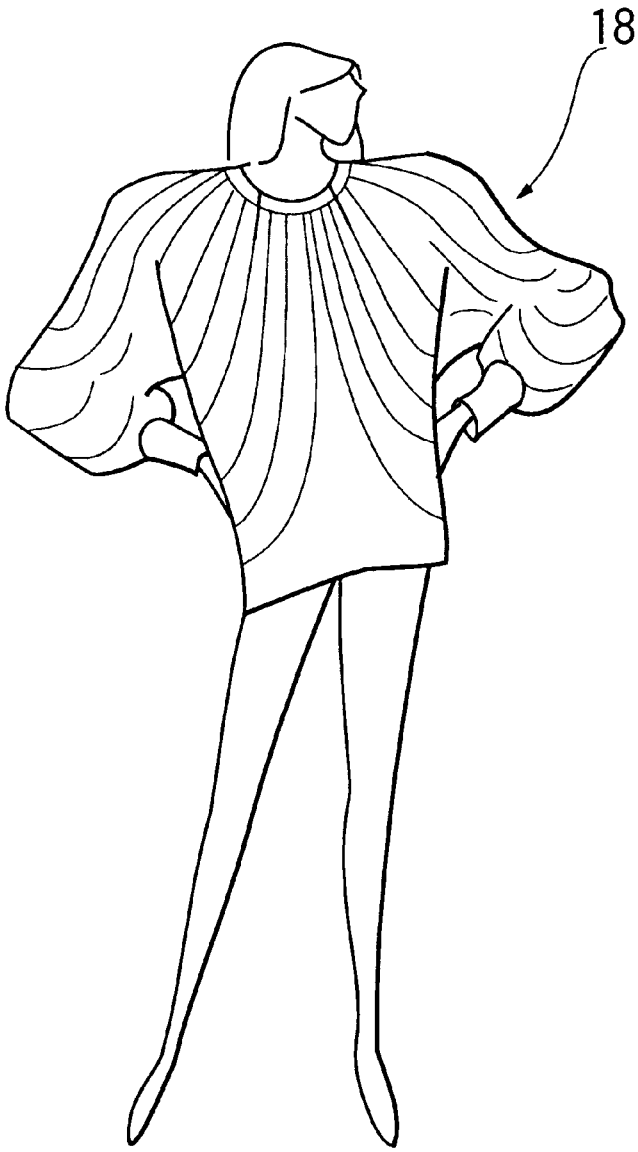
FIG. 4 shows a second sweater knitted according to the second entirely deployed pattern shown in FIG. 3.

FIG. 3 shows a second entirely deployed pattern and pattern pieces thereof in accordance with a second embodiment. FIG. 4 shows a second sweater knitted according to the second entirely deployed pattern shown in FIG. 3.

In the second embodiment, it is predetermined to create a collarless long sleeve sweater including a front bodice portion, a back bodice portion, and long sleeve portions. More specifically, a second predetermined design has a round neckline. It also has the long sleeve portions in Kimono sleeve style integrally connected with the front and back bodice portions forming curved under sleeve lines and provided with cuffs. The front and back bodice portions are designed to allow for extra ease of movement.

Explaining details of the second entirely deployed pattern 10 (shown by solid lines), the front bodice portion is indicated at 10*a*, the back bodice portion at 10*b*, sleeve portions at 10*c*, the cuffs at 10*d*, and the round neckline at 10*e*. Further, darts indicated at 12*a*, 12*b* are for flattening the fullness of the front and back bodice portions and those indicated at 12*c* are for flattening the round shoulder portions. As can be understood from the part shown by the thick lines in FIG. 3, the second predetermined shape according to the second embodiment is flattened cutting along under sleeve lines 14*a*, side lines 14*b* and a center back line 14*c* of the back bodice portion. One-dot chain lines 16 show folding lines of the sleeve portions.

Then, the second entirely deployed pattern 10 is observed to determine how it should be divided, i.e., pattern pieces. The second entirely deployed pattern 10 has few corners and clippings and has a rather arcuate shape in general. Therefore, it is divided into a plurality of arcuate elongated divided areas to form pattern pieces. In doing so, the clippings are intervened between an elongated pattern piece and an adjacent elongated pattern piece so that the second entirely deployed pattern can be divided into simple elongated shapes of pattern pieces. Based on the pattern pieces, even beginners be able to create knitted pieces without complications.

Subsequently, elongated knitted pieces are created out of yarns in different collars based on each of the elongated pattern pieces and joined to each other in accordance with an arrangement of the pattern pieces of the entirely deployed pattern to form a joined knitted cloth.

Then, the joined knitted cloth is folded in the same direction along the sleeve folding lines shown in one-dot chain lines in FIG. 3, and the edges shown by the thick lines are aligned to be joined to each other to form the long sleeve sweater 18 with arcuate stripes of an ornamental design as shown in FIG. 4.

Figure 5:
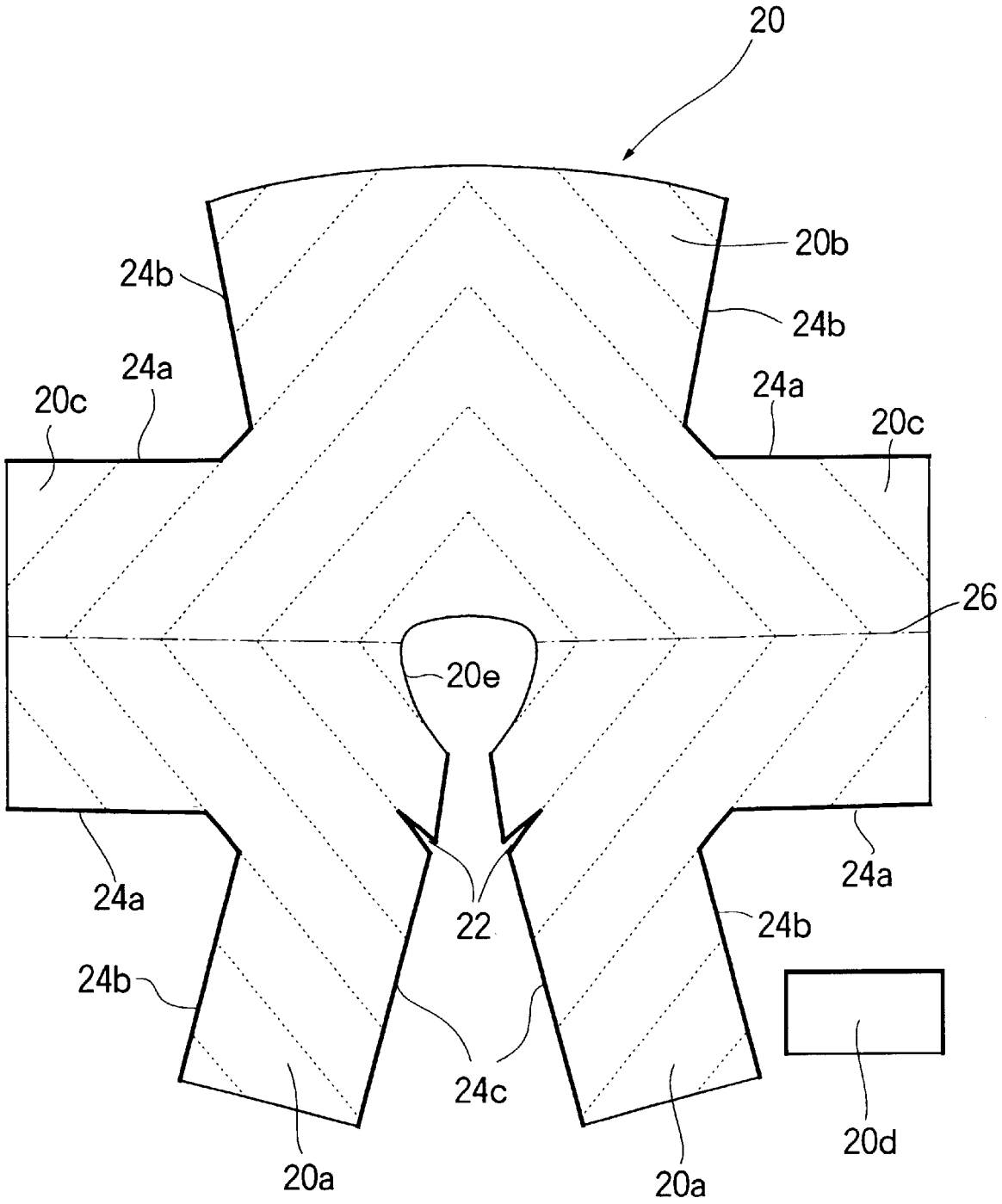
FIG. 5 shows a third entirely deployed pattern and pattern pieces thereof in accordance with a third embodiment.
Figure 6:
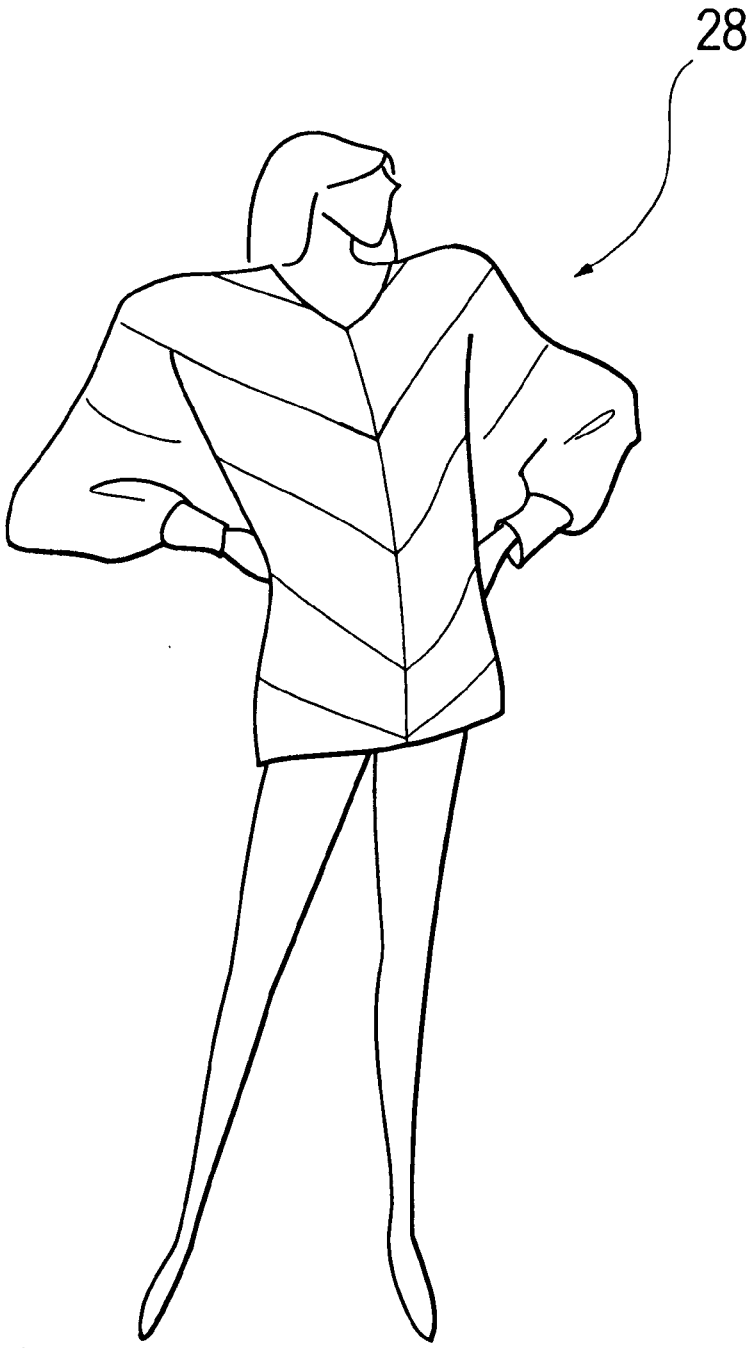
FIG. 6 shows a third sweater knitted according to the third entirely deployed pattern shown in FIG. 5.

FIG. 5 shows a third entirely deployed pattern and pattern pieces thereof in accordance with a third embodiment. FIG. 6 shows a third sweater knitted according to the third entirely deployed pattern shown in FIG. 5.

In the third embodiment, it is predetermined to create a collarless long sleeve sweater including a front bodice portion, a back bodice portion, and long sleeve portions. More specifically, a third predetermined design has a V-neckline. It also has the long sleeve portions with cuffs. The front and back bodice portions thereof are designed to be slightly wider toward lower edges thereof.

Explaining details of the third entirely deployed pattern 20 (shown by solid lines), the front bodice portion is indicated at 20*a*, the back bodice portion at 20*b*, sleeve portions at 20*c*, the cuffs at 20*d*, and the V-neckline at 20*e*. Further, darts indicated at 22 are for flattening the fullness of the breast portions of the front bodice portion. As can be understood from the part shown by the thick lines in FIG. 5, the third predetermined shape according to the third embodiment is deployed by cutting along under sleeve lines 24*a*, side lines 24*b* and a center front line 24*c*. One-dot chain lines 26 show folding lines of the sleeve portions.

Then, the third entirely deployed pattern 20 is observed to determine how it should be divided, i.e., shapes of pattern pieces. In this embodiment, the third entirely deployed pattern 20 is divided into a plurality of elongated divided areas extending in substantially diamond shapes to form pattern pieces. In doing so, the darts 22 are intervened between an elongated pattern piece and an adjacent elongated pattern piece so that the third entirely deployed pattern can be divided into simple elongated shapes of pattern pieces. Based on the pattern pieces, even beginners shall find it easy to create knitted pieces. Shaping corners of the diamond shapes can be easily performed by a common technique, i.e., "turning the work piece" at regular intervals before the end of the row.

Subsequently, elongated knitted pieces are created out of yarns in different colours based on each of the elongated pattern pieces and joined to each other in accordance with an arrangement of the pattern pieces of the entirely deployed pattern to form a joined knitted cloth.

Then, the joined knitted cloth is folded in the same direction along the sleeve folding lines shown in the one-dot chain lines in FIG. 5 and the edges shown by the thick lines are aligned to be joined to each other to form the long sleeve sweater 28 with V-shape stripes of an ornamental design which are symmetrical with respect to the front center line as shown in FIG. 6.

Figure 7:
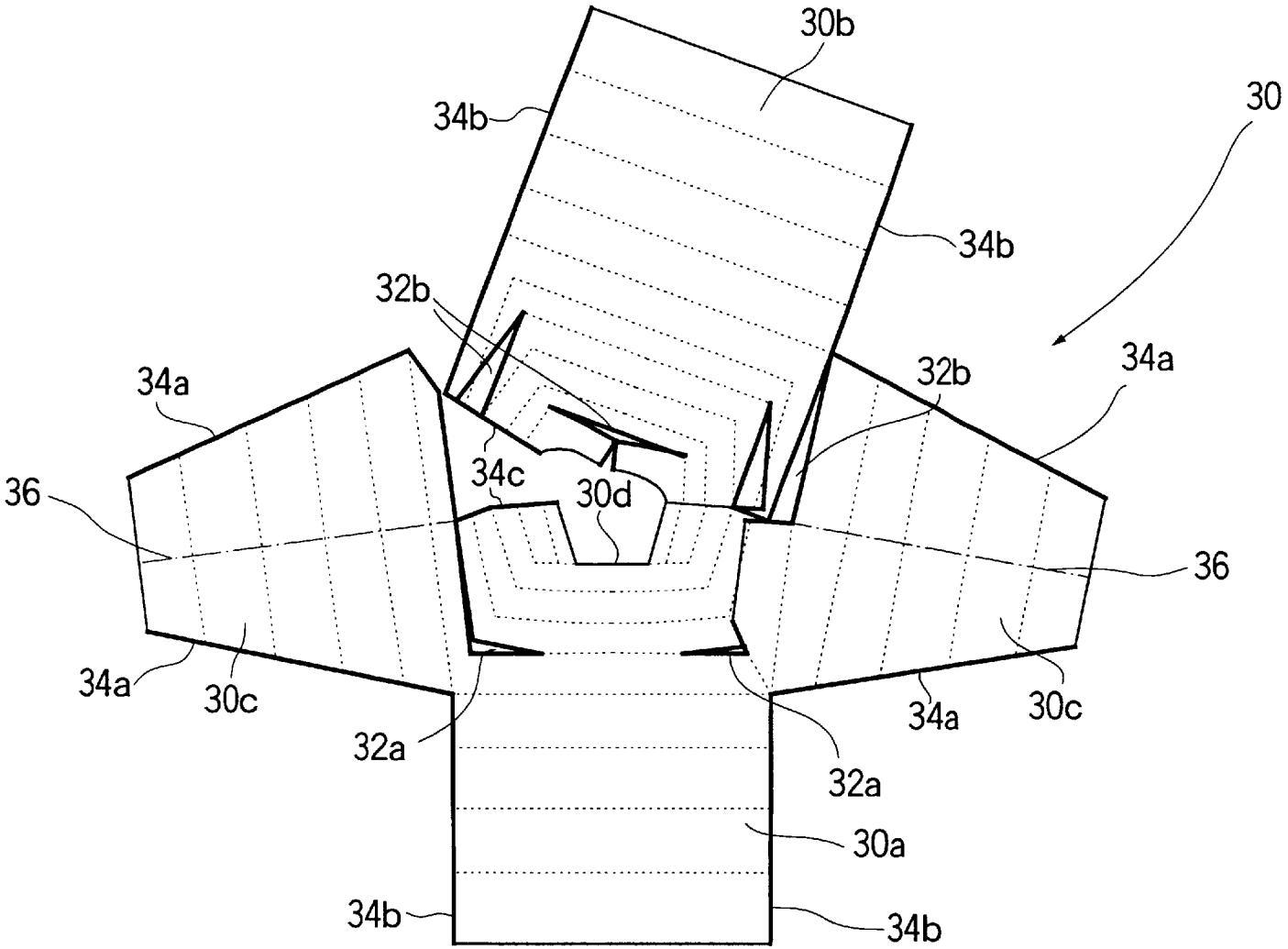
FIG. 7 shows a fourth entirely deployed pattern and pattern pieces thereof in accordance with a fourth embodiment.
Figure 8:
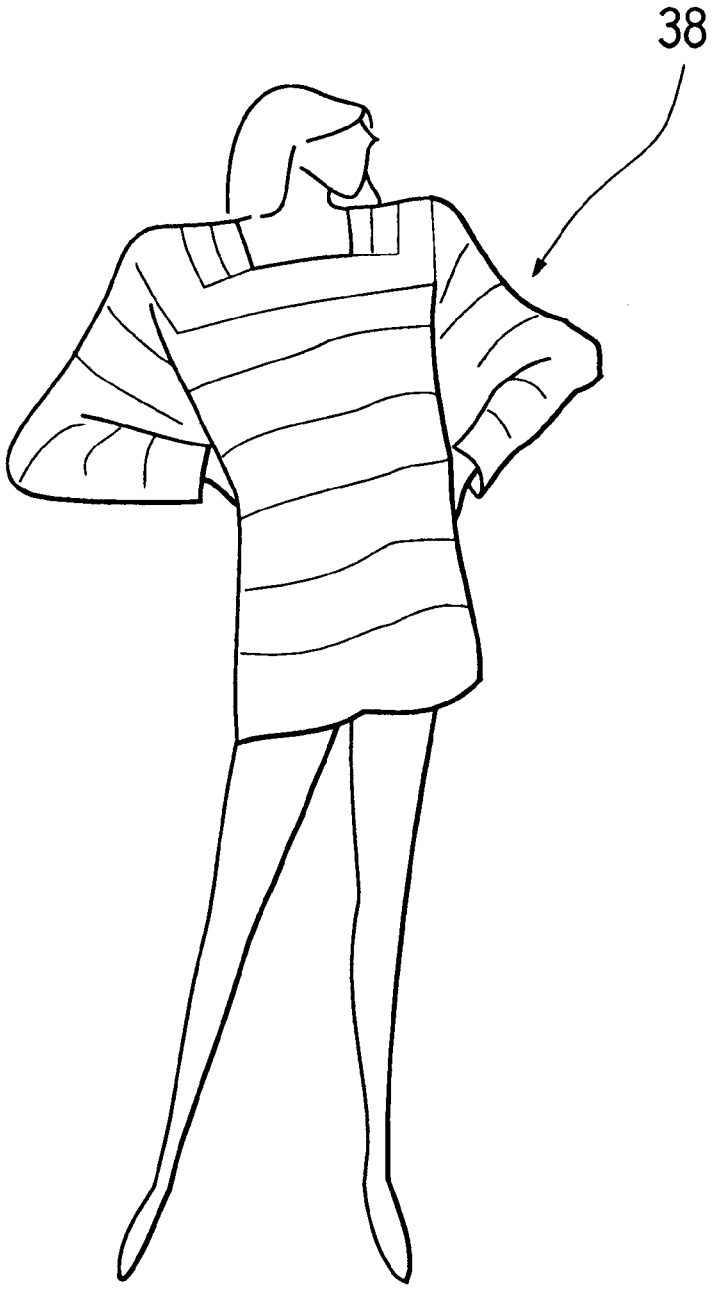
FIG. 8 shows a fourth sweater knitted according to the fourth entirely deployed pattern shown in FIG. 7.

FIG. 7 shows a fourth entirely deployed pattern and pattern pieces thereof in accordance with a fourth embodiment. FIG. 8 shows a fourth sweater knitted according to the fourth entirely deployed pattern shown in FIG. 7.

In the fourth embodiment, it is predetermined to create a collarless long sleeve sweater including a front bodice portion, a back bodice portion, and long sleeve portions. More specifically, a fourth predetermined design has a square neckline. It also has straight side lines and straight sleeves.

Explaining details of the fourth entirely deployed pattern 30 (shown by solid lines), the front bodice portion is indicated at 30*a*, the back bodice portion at 30*b*, sleeve portions at 30*c*, and the square neckline at 30*d*. Further, clippings indicated at 32*b* are for flattening a round back portion of the back bodice portion. As can be understood from the part shown by the thick lines in FIG. 7, the fourth predetermined shape according to the fourth embodiment is deployed by cutting along under sleeve lines 34*a*, the side lines 34*b* and right shoulder line 34*c*. One-dot chain lines 36 show folding lines of the sleeve portions.

Then, the fourth entirely deployed pattern 30 is observed to determine how it should be divided, i.e., shapes of pattern pieces. In this embodiment, taking the shape of the neckline and the clippings 32*b* into consideration, the fourth entirely deployed pattern 30 is divided into a plurality of U-shaped divided areas around the square neckline and the sleeve portions and the waist portions are divided into straight elongated divided areas to form pattern pieces. In doing so, the clippings 32*a* and 32*b* are intervened between an elongated pattern piece and an adjacent elongated pattern piece so that the fourth entirely deployed pattern 30 can be divided into simple elongated shapes of pattern pieces. Based on the pattern pieces, even beginners shall find it easy to create knitted pieces. Corners of the U-shaped elongated pieces can be easily performed by a common technique, i.e., turning the work piece at regular intervals before the end of the row.

Subsequently, elongated knitted pieces are created out of yarns in different colours based on each of the elongated pattern pieces and joined to each other in accordance with an arrangement of the pattern pieces of the entirely deployed pattern to form a joined knitted cloth.

Then, the joined knitted cloth is folded in the same direction along the sleeve folding lines shown in the one-dot chain lines in FIG. 7 and the edges shown by the thick lines are aligned to be joined to each other to form the long sleeve sweater 38 with lateral stripes of an ornamental design as shown in FIG. 8.

Figure 9:
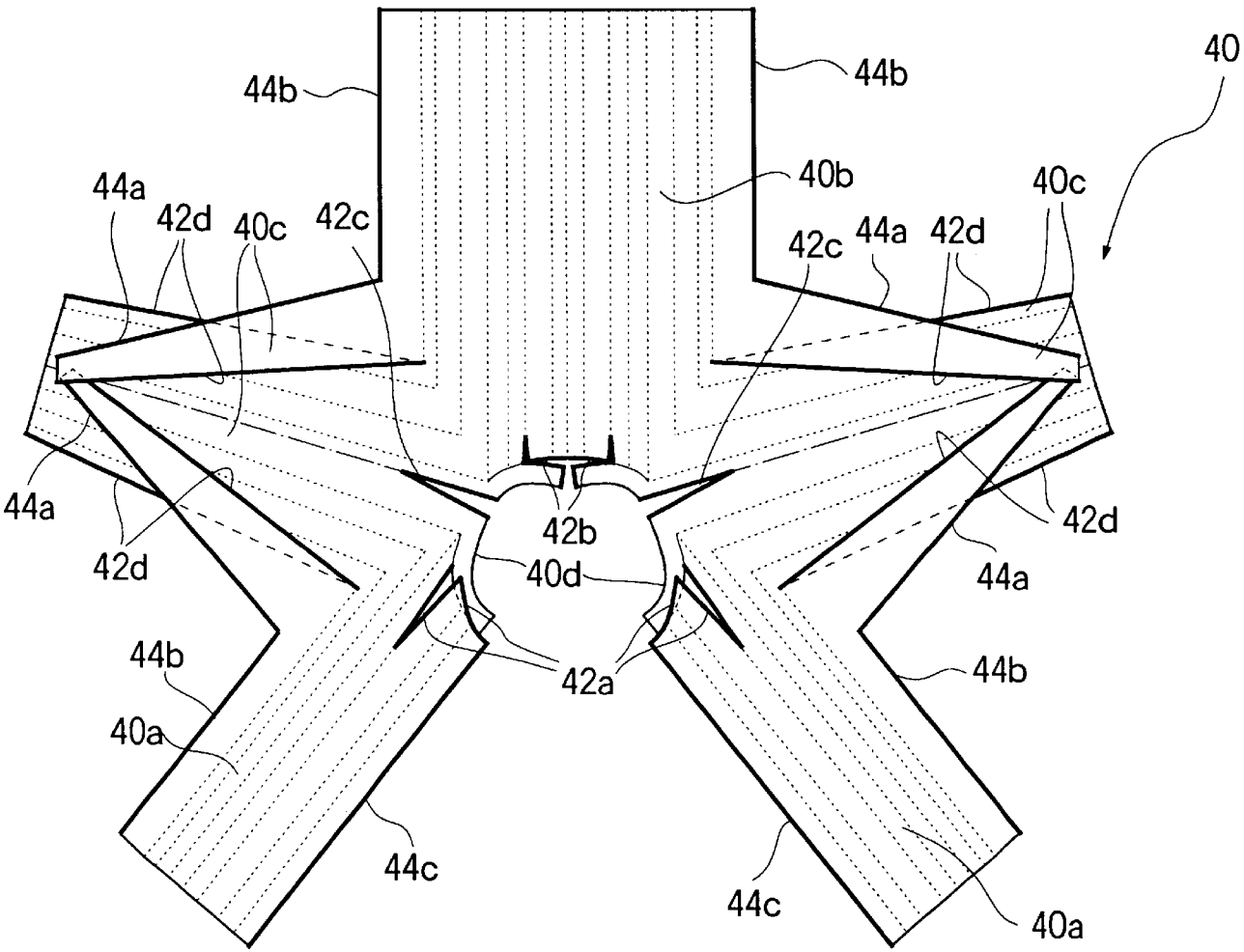
FIG. 9 shows a fifth entirely deployed pattern and pattern pieces thereof in accordance with a fifth embodiment.
Figure 10:
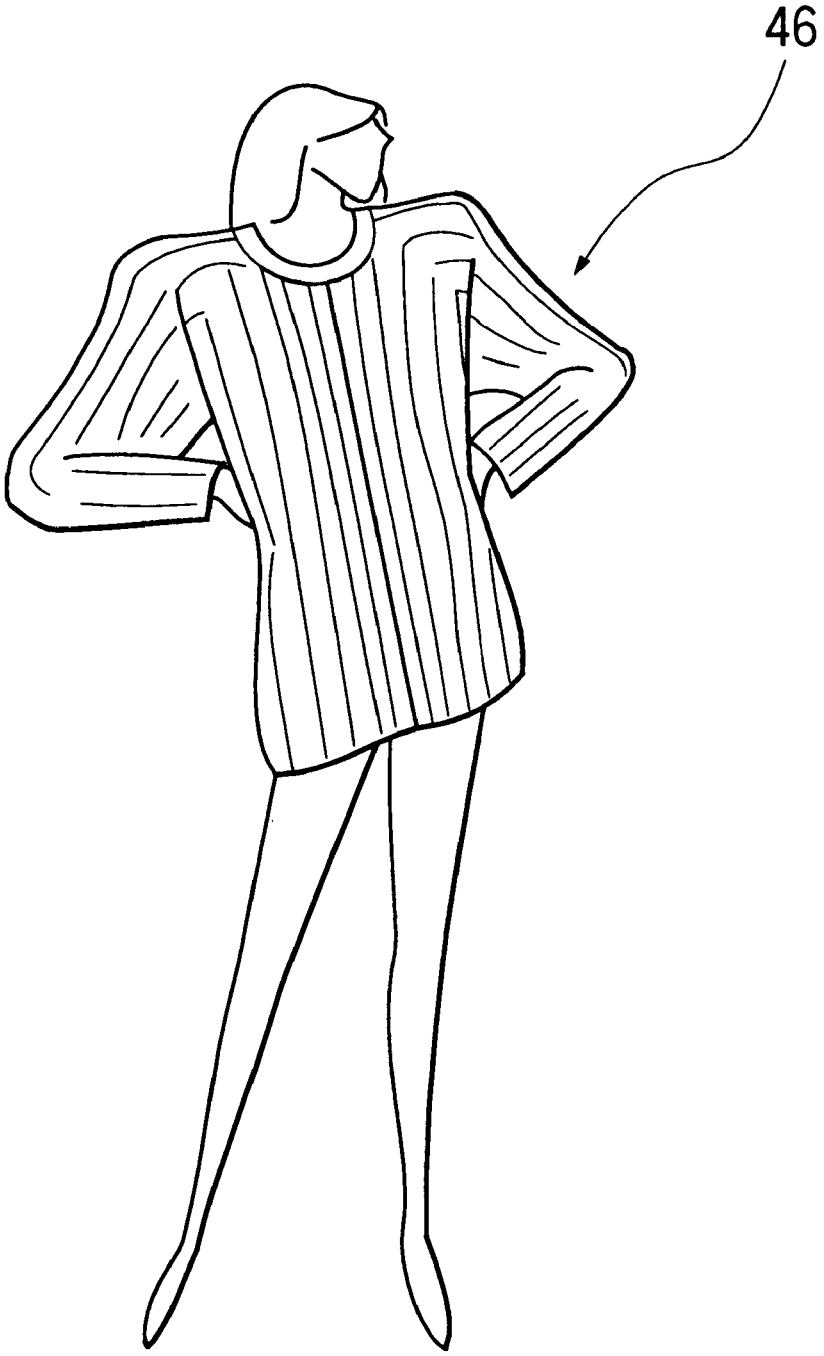
FIG. 10 shows a fifth sweater knitted according to the fifth entirely deployed pattern shown in FIG. 9.

FIG. 9 shows a fifth entirely deployed pattern and pattern pieces thereof in accordance with a fifth embodiment. FIG. 10 shows a fifth sweater knitted according to the fifth entirely deployed pattern shown in FIG. 9.

In the fifth embodiment, it is predetermined to create a collarless long sleeve sweater including a front bodice portion, a back bodice portion, and long sleeve portions. More specifically, a fifth predetermined design has a round neckline. It also has straight side lines and loose sleeve portions.

Explaining details of the fifth entirely deployed pattern 40 (shown by solid lines), the front bodice portion is indicated at 40*a*, the back bodice portion at 40*b*, sleeve portions at 40*c*, and the round neck line at 40*d*. Further, clippings indicated at 42*a* are for flattening the fullness of the breast portions of the front bodice portion, those indicated at 42*b* are for flattening round portion of the back bodice portion, those indicated at 42*c* are for slanted shoulder lines and those indicated at 42*d* are for loose portions of the sleeves. As can be understood from the part shown by the thick lines in FIG. 9, the fifth predetermined shape according to the fifth embodiment is deployed by cutting along under sleeve lines 44*a*, the side lines 44*b* and a front center line 44*c*.

Then, the fifth entirely deployed pattern 40 is observed to determine how it should be divided, i.e., shapes of pattern pieces. Since the fifth entirely deployed pattern 40 has a straight front bodice portion 40*a*, the back bodice portion 40*b* and the sleeve portions 40*c*, it is divided into a plurality of L-shaped divided areas extending from the front bodice portion 40*a* to the sleeve portions 40*c* and from the back bodice portion 40*b* to the sleeve portions 40*c* to form pattern pieces. In doing so, the clippings 42*a*, 42*b*, 42*c* and 42*d* are intervened between an elongated pattern piece and an adjacent elongated pattern piece so that the fifth entirely deployed pattern 40 can be divided into simple elongated shapes of pattern pieces. Based on the pattern pieces, even beginners shall find it easy to create knitted pieces. Corners of the U-shaped elongated pieces can be easily performed by a common technique, i.e., turning the work piece at regular intervals before the end of the row.

Subsequently, elongated knitted pieces are created out of yarns in different colours based on each of the elongated pattern pieces and joined to each other in accordance with an arrangement of the pattern pieces of the entirely deployed pattern to form a joined knitted cloth.

Then, the joined knitted cloth is folded in the same direction along the sleeve folding lines shown in one-dot chain lines in FIG. 9 and the edges shown by the thick lines are aligned to be joined to each other to form the long sleeve sweater 46 with vertical stripes of an ornamental design as shown in FIG. 10.

Figure 11:
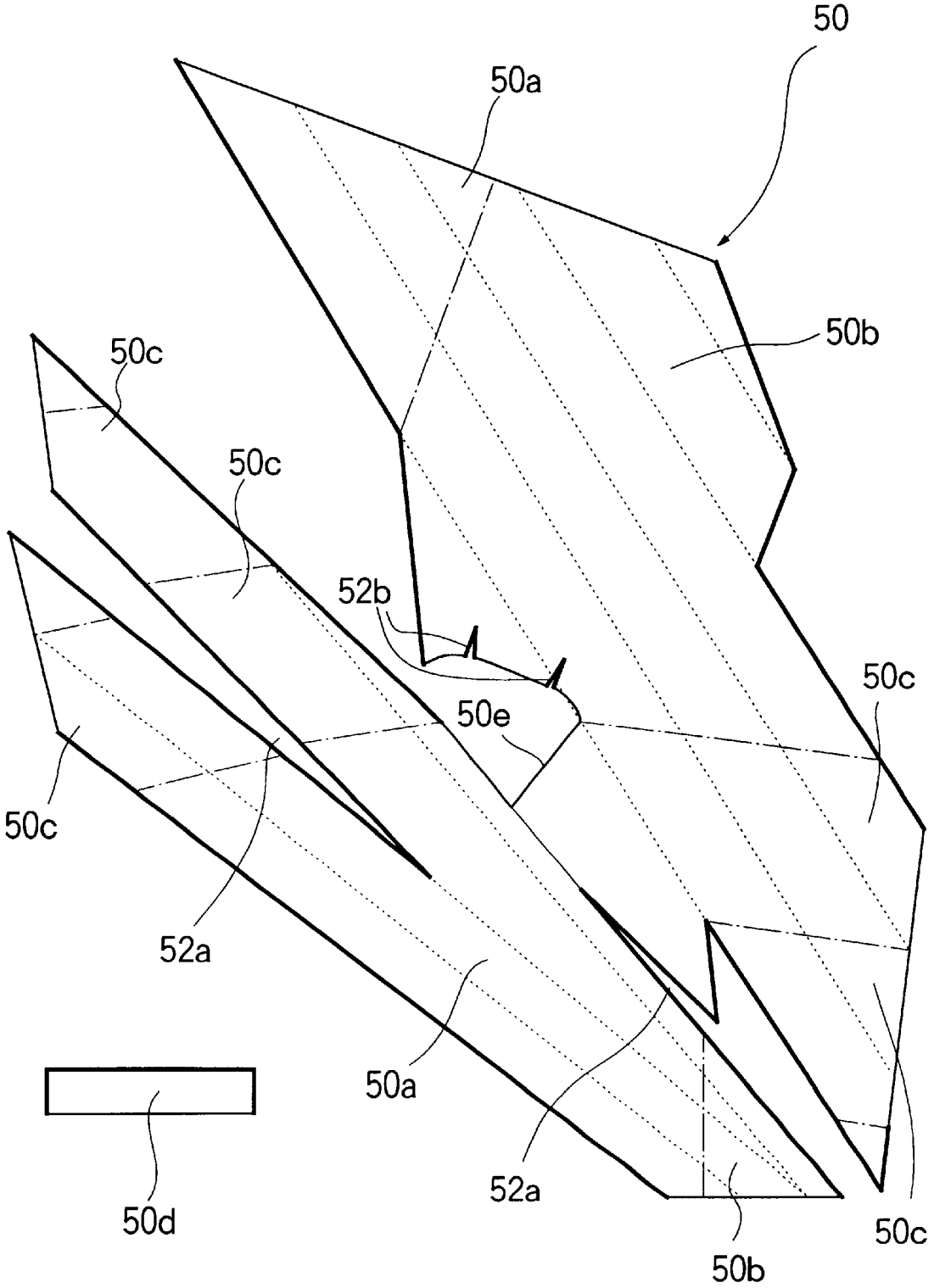
FIG. 11 shows a sixth entirely deployed pattern and pattern pieces thereof in accordance with a sixth embodiment.
Figure 12:
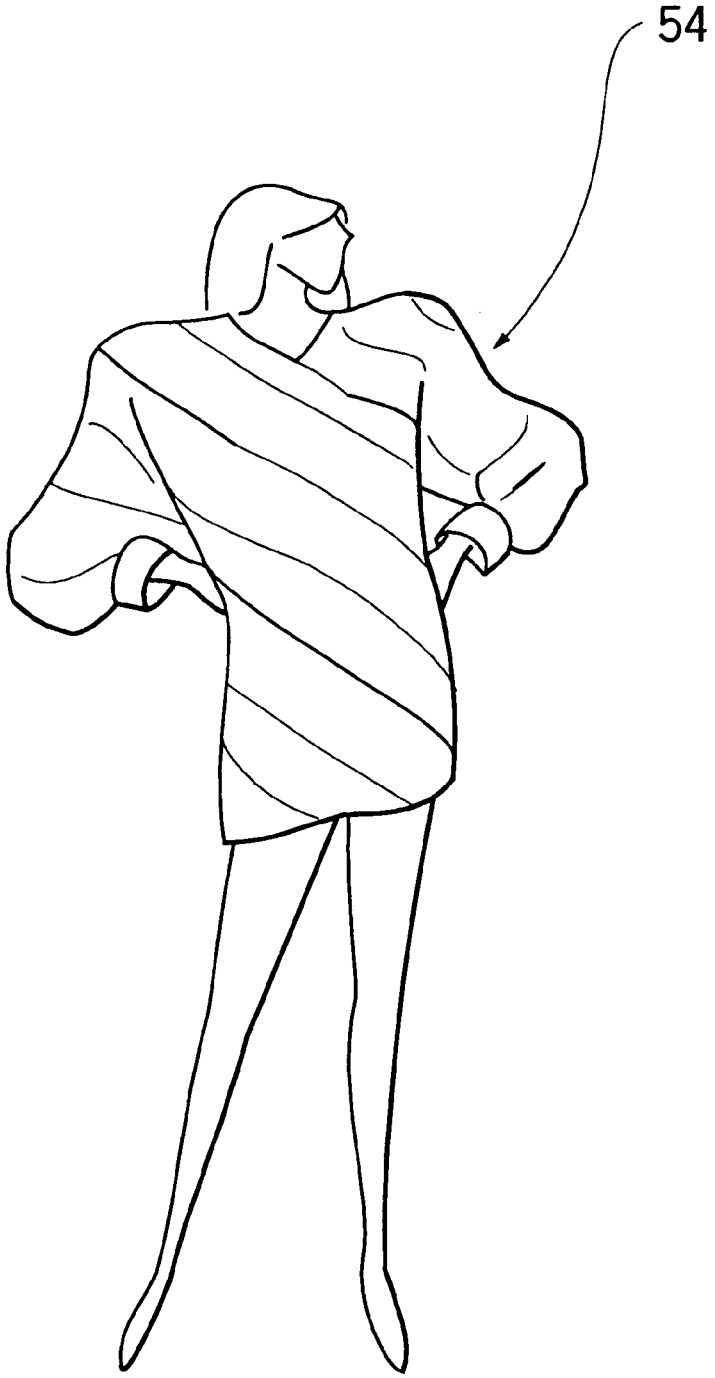
FIG. 12 shows a sixth sweater knitted according to the sixth entirely deployed pattern shown in FIG. 11.

FIG. 11 shows a sixth entirely deployed pattern and pattern pieces thereof in accordance with a sixth embodiment. FIG. 12 shows a sixth sweater knitted according to the sixth entirely deployed pattern shown in FIG. 11.

In the sixth embodiment, it is predetermined to create a collarless long sleeve sweater including a front bodice portion, a back bodice portion, and long sleeve portions. More specifically, a sixth predetermined design has a V-neckline. It also has straight side lines and puffed sleeve portions with cuffs.

Explaining details of the sixth entirely deployed pattern 50 (shown by solid lines), the front bodice portion is indicated at 50*a*, the back bodice portion at 50*b*, sleeve portions at 50*c*, the cuffs at 50*d*, and the V-neckline at 50*e*. Further, clippings indicated at 52*a* are for flattening the fullness of the breast portions of the front bodice portion, and the darts indicated at 52*b* are for flattening round portion of the back bodice portion. As can be understood from the part shown by the thick lines in FIG. 11, the sixth predetermined shape according to the sixth embodiment is deployed by cutting in elongated shapes extending over the sleeve portions 50*c*, the front bodice portions 50*a* and the back bodice portions 50*b* (the left lower half of the entirely deployed pattern 50 shown in FIG. 1) and elongated shapes extending over the front bodice portions 50*a*, the back bodice portions 50*b* and the sleeve portions 50*c* (the right upper half of the same).

Then, the sixth entirely deployed pattern 50 is observed to determine how it should be divided, i.e., shapes of pattern pieces. Since the sixth entirely deployed pattern 50 has an elongated shape in general, it is divided into a plurality of elongated shapes of divided areas to form elongated pattern pieces. In doing so, the clippings 52*a* are intervened between an elongated pattern piece and an adjacent elongated pattern piece so that the sixth entirely deployed pattern 50 can be divided into simple elongated shapes of pattern pieces. Based on the pattern pieces, long elongated shape of the knitted pieces can be simply created.

Subsequently, elongated knitted pieces are created out of yarns of different colors based on each of the elongated pattern pieces and joined to each other in accordance with an arrangement of the pattern pieces of the entirely deployed pattern to form a joined knitted cloth. Then, the joined knitted cloth is folded in the same direction along the sleeve folding lines shown in one-dot chain lines in FIG. 11 and the edges shown by the thick lines are aligned to be joined to each other to form the long sleeve sweater 54 with inclined stripes of an ornamental design as shown in FIG. 12.

Figure 13:
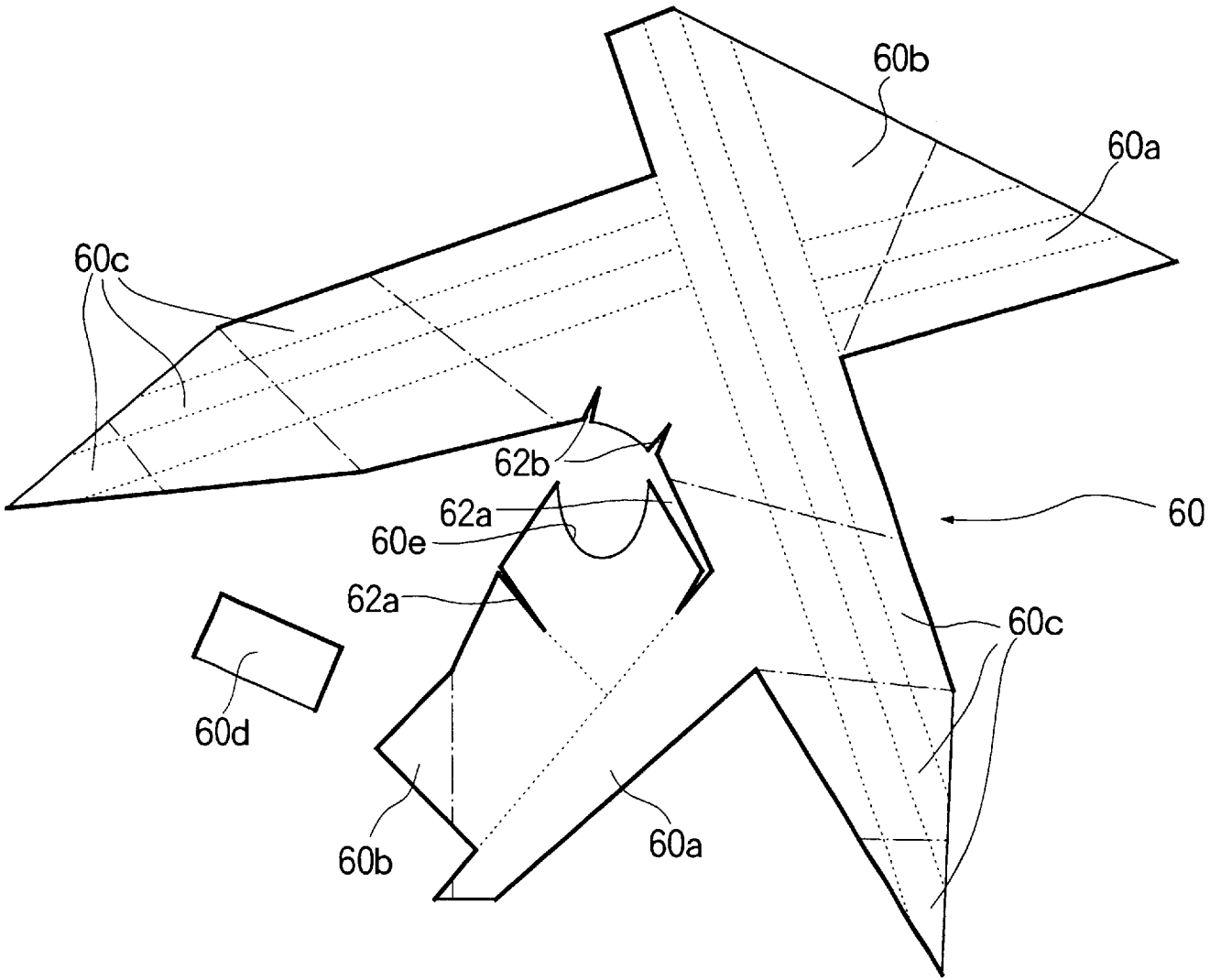
FIG. 13 shows a seventh entirely deployed pattern and pattern pieces thereof in accordance with a seventh embodiment.
Figure 14:
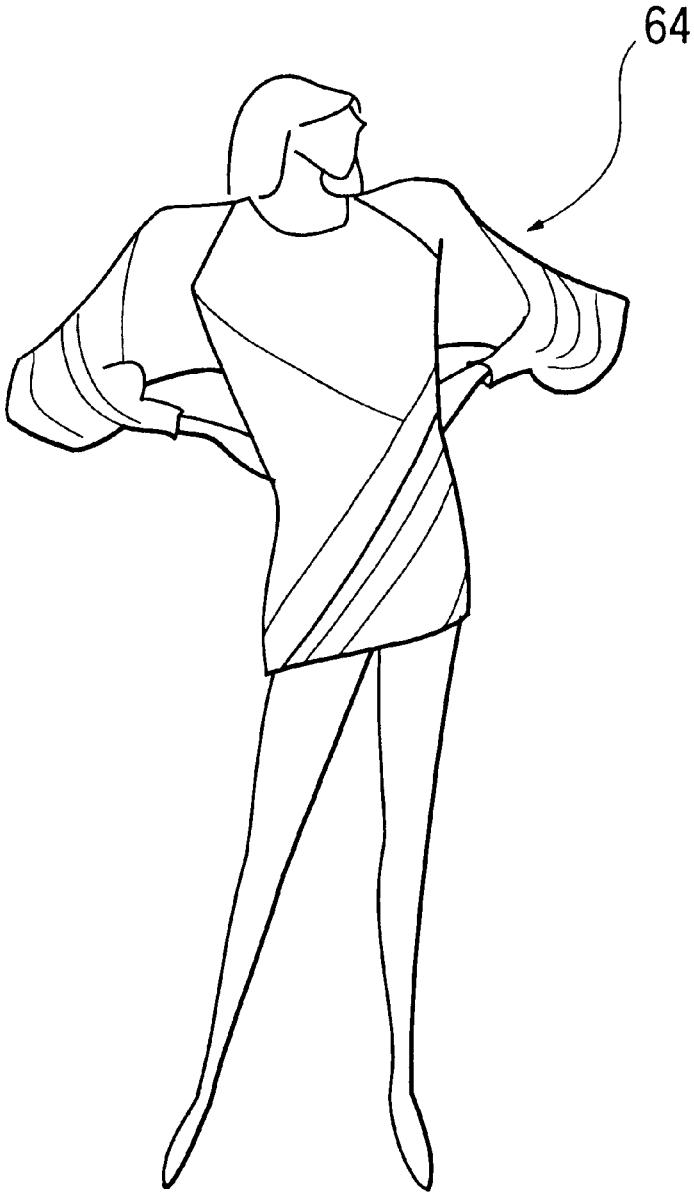
FIG. 14 shows a seventh sweater knitted according to the seventh entirely deployed pattern shown in FIG. 13.

FIG. 13 shows a seventh entirely deployed pattern and pattern pieces thereof in accordance with a seventh embodiment. FIG. 14 shows a seventh sweater knitted according to the seventh entirely deployed pattern shown in FIG. 13.

In the seventh embodiment, it is predetermined to create a collarless long sleeve sweater including a front bodice portion, a back bodice portion, and long sleeve portions. More specifically, a seventh predetermined design has a round neckline. It also has straight side lines and puffed sleeve portions with cuffs.

Explaining details of the seventh entirely deployed pattern 60 (shown by solid lines), the front bodice portion is indicated at 60*a*, the back bodice portion at 60*b*, the sleeve portions at 60*c*, the cuffs at 60*d*, and the round neckline at 60*e*. Further, clippings indicated at 62*a* are for flattening the fullness of the breast portions of the front bodice portion, and the darts indicated at 62*b* are for flattening round portion of the back bodice portion. As can be understood from the part shown by the thick lines in FIG. 13, the seventh predetermined shape according to the seventh embodiment is deployed by cutting in an X-shape having two elongated areas intersecting to each other.

Then, the seventh entirely deployed pattern 60 is observed to determine how it should be divided, i.e., shapes of pattern pieces. Since the seventh entirely deployed pattern 60 has the X-shape having two elongated areas intersecting to each other, it is divided into a plurality of elongated shapes of divided areas to form elongated pattern pieces. The areas which does not have elongated shapes are divided into rectangular divided areas. In doing so, the clippings 62*a* are intervened between a pattern piece and an adjacent pattern piece so that the seventh entirely deployed pattern 60 can be divided into simple shapes of pattern pieces. Based on the pattern pieces, an elongated shape and rectangular shape of the knitted pieces can be simply created.

Subsequently, rectangular shape and elongated knitted pieces are created out of yarns of different colors based on each of the pattern pieces and joined to each other in accordance with an arrangement of the pattern pieces of the entirely deployed pattern to form a joined knitted cloth. Then, the joined knitted cloth is folded in the same direction along the sleeve folding lines shown in the one-dot chain lines in FIG. 13 and the edges shown by the thick lines are aligned to be joined to each other to form the long sleeve sweater 64 with inclined stripes of an ornamental design as shown in FIG. 14.

Figure 15:
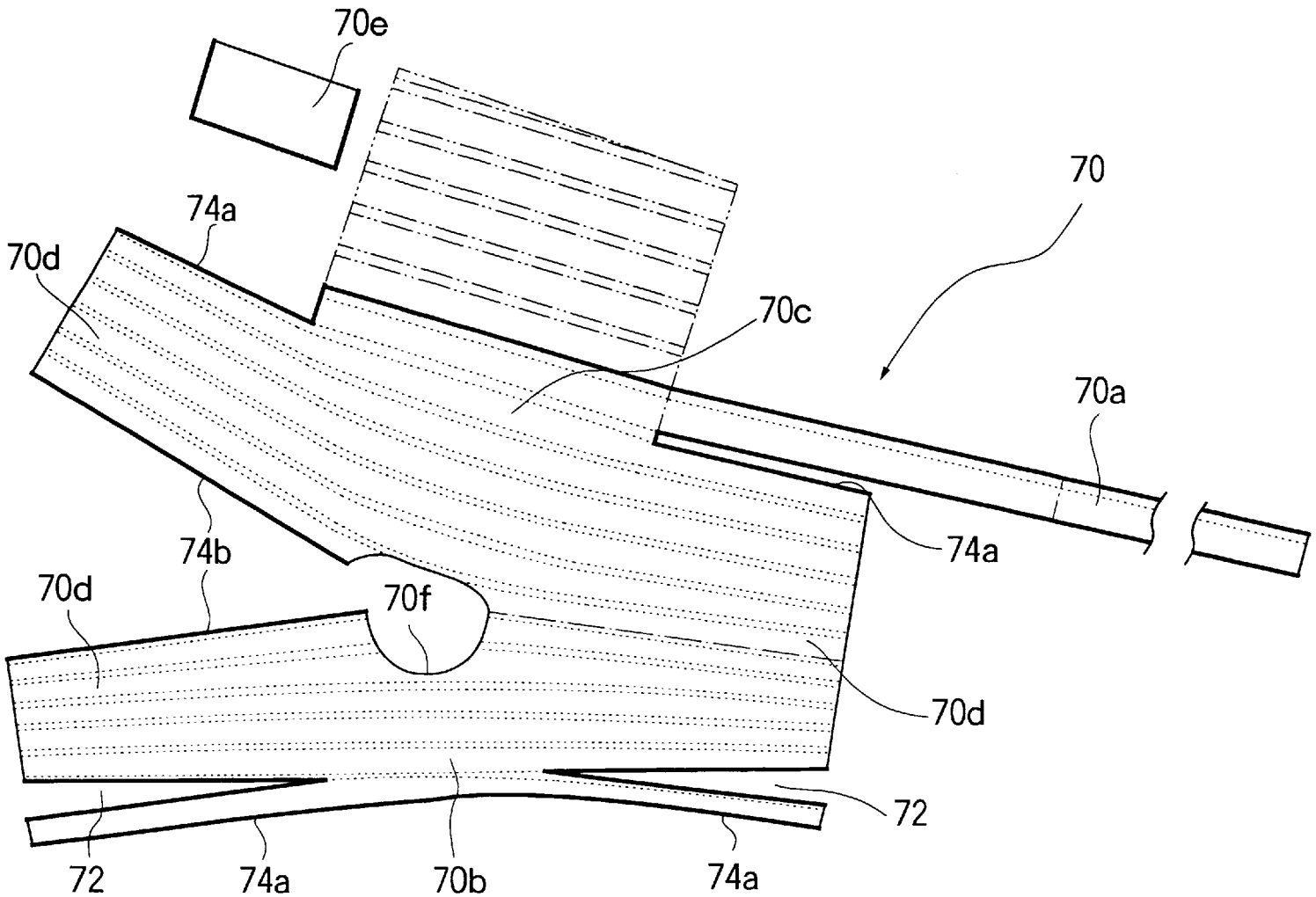
FIG. 15 shows an eighth entirely deployed pattern and pattern pieces thereof in accordance with an eighth embodiment.
Figure 16:
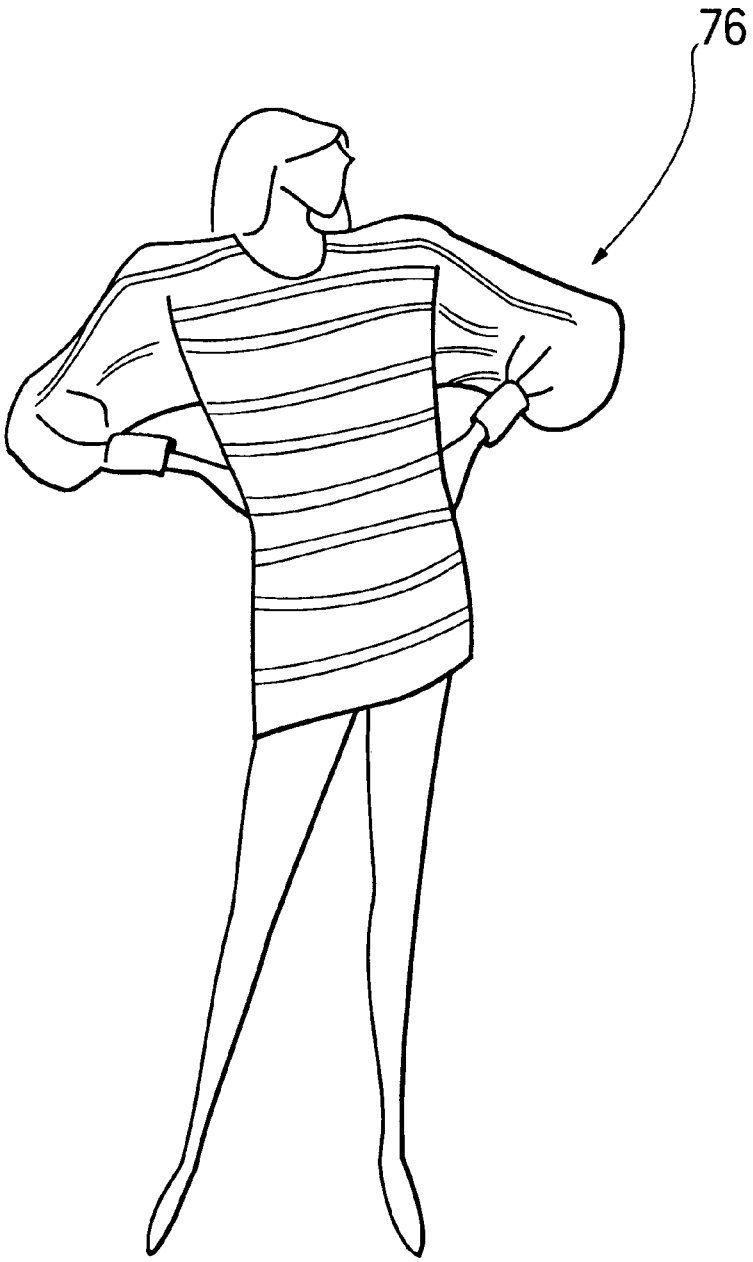
FIG. 16 shows an eighth sweater knitted according to the eighth entirely deployed pattern shown in FIG. 15.

FIG. 15 shows an eighth entirely deployed pattern and pattern pieces thereof in accordance with an eighth embodiment. FIG. 16 shows an eighth sweater knitted according to the eighth entirely deployed pattern shown in FIG. 15.

In the eighth embodiment, it is predetermined to create a collarless long sleeve sweater including a front bodice portion, a back bodice portion, and long sleeve portions. More specifically, an eighth predetermined design has a round neckline. It also has a cylindrical bodice portion with straight side lines and straight sleeve portions.

Explaining details of the eighth entirely deployed pattern 70 (shown by solid lines), the front and back bodice portions at 70*a*, breast portions of the front bodice portion is indicated at 70*b*, back portion of the back bodice portion at 70*c*, the sleeve portions at 70*d*, the cuffs at 70*e*, and the round neckline at 70*f*. Further, clippings indicated at 72 are for flattening round elbow portions of the sleeve portions. As can be understood from the part shown by the thick lines In FIG. 15, the eighth predetermined shape according to the eighth embodiment is deployed by cutting the front and back bodice portions in a spiral shape and the sleeve portions 70*d* along the under sleeve lines 74*a* thereof, and the upper sleeve line 74*b* of the right sleeve.

Then, the eighth entirely deployed pattern 70 is observed to determine how it should be divided, i.e., shapes of pattern pieces. Since the eighth entirely deployed pattern 70 has an elongated shape for the lower half of the front and back bodice portions and an elongated shape extending over the left sleeve portion 70*d*, the upper half portion 70*b* of the front bodice portion, the back portion 70*c* of the back body portion and the right sleeve portion 70*d*. Therefore, the lower half of the front and back bodice portions can be divided into one long elongated divided area. Further, the elongated divided area is divided in an elongated direction into a broad elongated area and a narrow elongated area as shown by the dotted lines in FIG. 15. The rest of the divided areas are subdivided into broad elongated areas and narrow elongated areas. In doing so, the clippings 72 are intervened between an elongated pattern piece and an elongated adjacent pattern piece so that the eighth entirely deployed pattern 70 can be divided into simple shapes of pattern pieces. Based on the pattern pieces, long elongated shape of the knitted pieces can be simply created.

Subsequently, the broad elongated shape and narrow elongated shape of knitted pieces are created out of yarns of different colors based on each of the pattern pieces. Then, the knitted pieces are folded along one-dot chain lines to be rolled up into a spiral form as shown by two-dot chain lines in FIG. 15. Further, the upper half portion is joined with the lower half bodice portion in accordance with the arrangement of the eighth entirely deployed pattern shown in FIG. 15 to form the long sleeve sweater 76 with broad and narrow stripes of an ornamental design as shown in FIG. 16.

Figure 17:
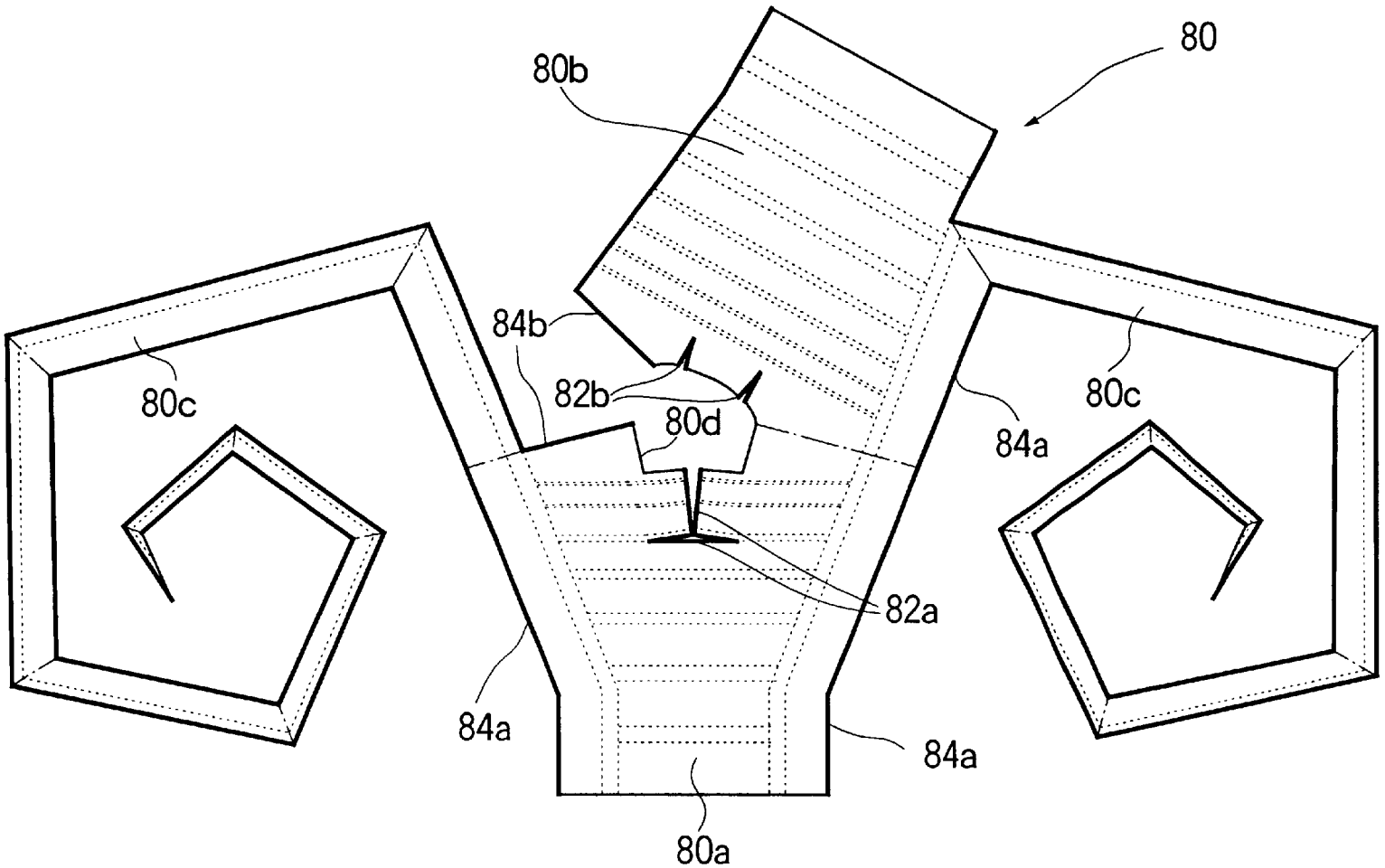
FIG. 17 shows a ninth entirely deployed pattern and pattern pieces thereof in accordance with a ninth embodiment.
Figure 18:
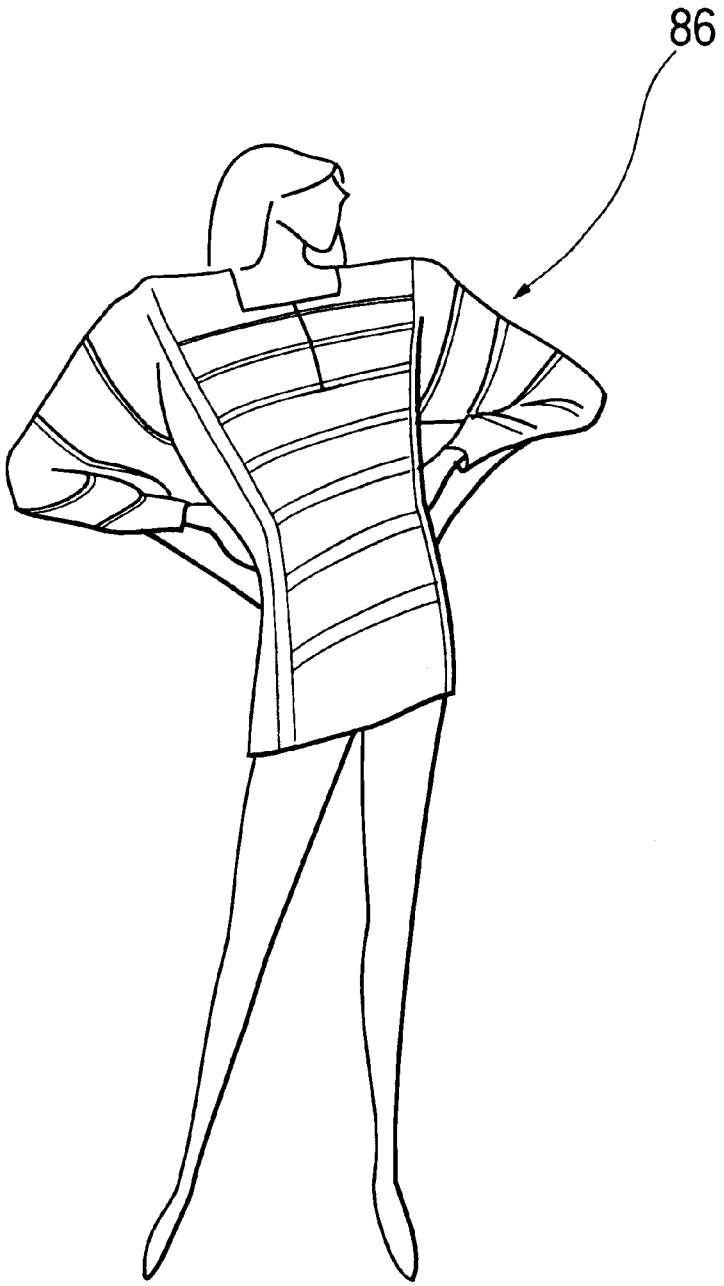
FIG. 18 shows a ninth sweater knitted according to the ninth entirely deployed pattern shown in FIG. 17.

FIG. 17 shows a ninth entirely deployed pattern and pattern pieces thereof in accordance with a ninth embodiment. FIG. 18 shows a ninth sweater knitted according to the ninth entirely deployed pattern shown in FIG. 17.

In the ninth embodiment, it is predetermined to create a collarless long sleeve sweater including a front bodice portion, a back bodice portion, and long sleeve portions. More specifically, a ninth predetermined design has a square neckline and fitted waist lines, and substantially conical sleeve portions, each of which extending from a wide armhole portion to a narrow cuff portion.

Explaining details of the ninth entirely deployed pattern 80 (shown by solid lines), the front bodice portion is indicated at 80*a*, the back bodice portion at 80*b*, the sleeve portions at 80*c*, and the square neckline at 80*d*. Further, clippings indicated at 82*a* are for flattening the fullness of the breast portion of the front bodice portion and those indicated at 82*b* are for flattening the round back bodice portion 80*b*. As can be understood from the part shown by the thick lines in FIG. 17, the ninth predetermined shape according to the ninth embodiment is deployed by cutting the sleeve portions in a spiral elongated shape and the front and back bodice portions 80*a*, 80*b* along the side lines 84*a* and the right shoulder line 84*b*. The round elbow portions of the sleeve portions are included in different widths of the spiral elongated shape of the sleeve portions as a result of the deployment.

Then, the ninth entirely deployed pattern 80 is observed to determine how it should be divided, i.e., shapes of pattern pieces. Since the ninth entirely deployed pattern 80 has an elongated spiral shape for the sleeve portions 80*c* and a substantially square shapes for the front and back bodice portions. Therefore, it can be divided into one elongated area extending from the sleeve portion 80*c* and the side portion of the front bodice portion 80*a* and the back bodice portion 80*b*.

The elongated area is further divided into a broad elongated area and a narrow elongated area as shown in FIG. 17. Furthermore, the front bodice portion 80*a* and the back bodice portion 80*b* are divided into horizontal elongated divided areas, each of which is also divided into a broad elongated area and a narrow elongated area to form pattern pieces. Based on the pattern pieces, long elongated shape of the knitted pieces can be simply created.

Subsequently, the broad elongated shape and narrow elongated shape of knitted pieces are created out of yarns of different colors based on each of the pattern pieces. Then, the sleeve portions 80*c* of the knitted pieces are folded along one-dot chain lines to be rolled up into a spiral form in which aligned edges are connected to each other. Further, the front and back portions are joined in accordance with the arrangement of the ninth entirely deployed pattern 80 in FIG. 17, the long sleeve sweater 86 with broad and narrow horizontal stripes of an ornamental design as shown in FIG. 18 is obtained. It is to be noted that the round elbow shape of the sleeve portions is formed when the elongated knitted piece having a gradually changing widths is rolled up into a spiral form.

Figure 19:
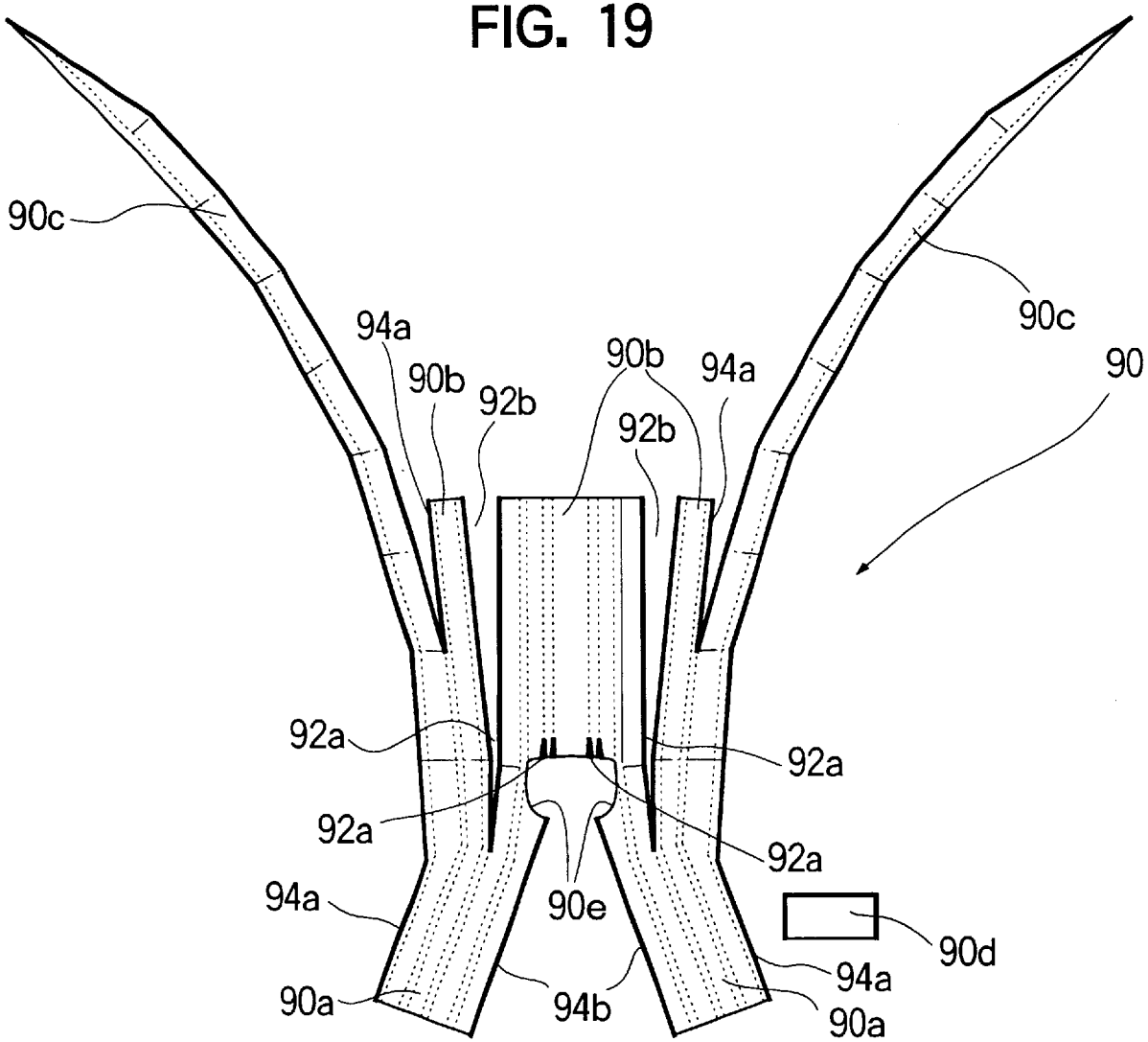
FIG. 19 shows a tenth entirely deployed pattern and pattern pieces thereof in accordance with a tenth embodiment.
Figure 20:
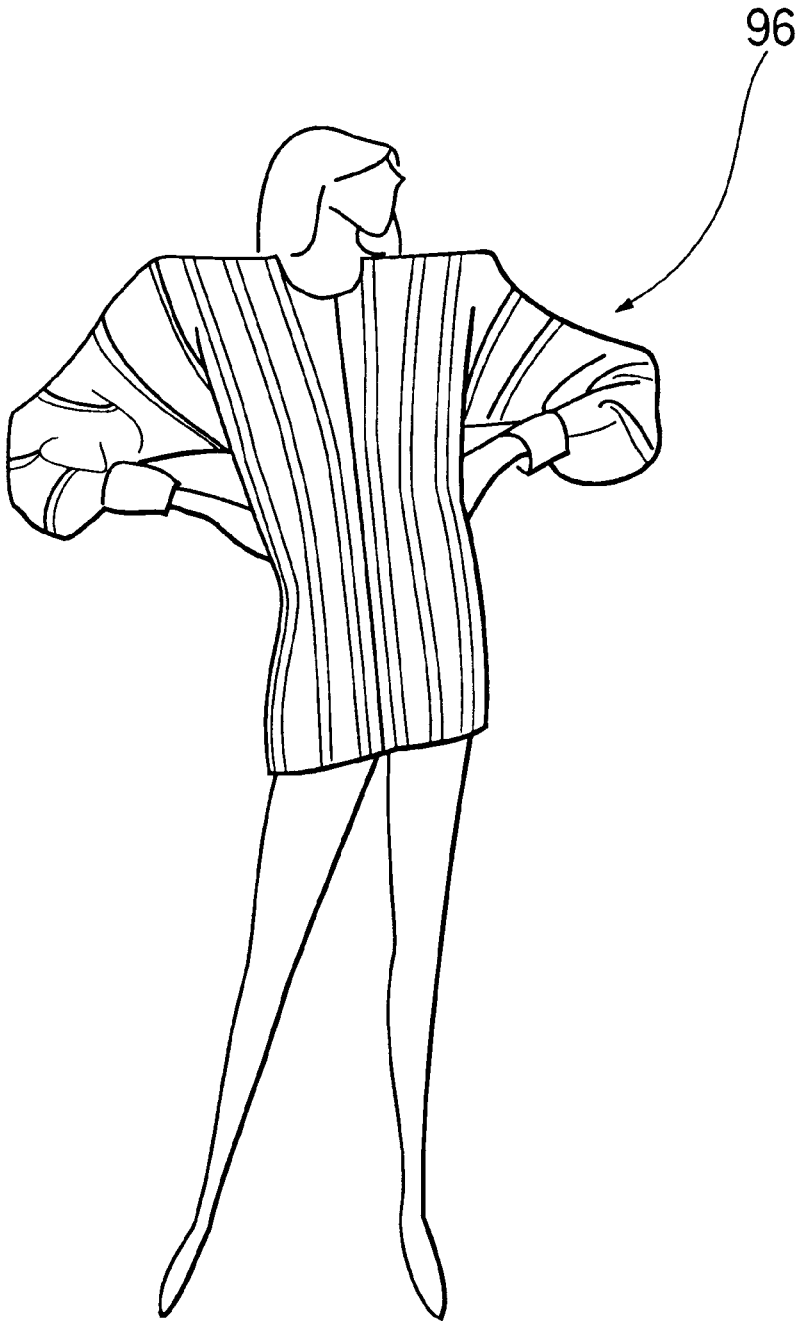
FIG. 20 shows a tenth sweater knitted according to the tenth entirely deployed pattern shown in FIG. 19.

FIG. 19 shows a tenth entirely deployed pattern and pattern pieces thereof in accordance with a tenth embodiment. FIG. 20 shows a tenth sweater knitted according to the tenth entirely deployed pattern shown in FIG. 19.

In the tenth embodiment, it is predetermined to create a collarless long sleeve sweater including a front bodice portion, a back bodice portion, and long sleeve portions. More specifically, a tenth predetermined design has a round neckline and a narrow waist line, and puffed sleeve portions with cuffs.

Explaining details of the tenth entirely deployed pattern 90 (shown by solid lines), the front bodice portion is indicated at 90*a*, the back bodice portion at 90*b*, the sleeve portions at 90*c*, the cuffs at 90*d* and the round neckline at 90*e*. Further, clippings indicated at 92*a* are for flattening the fullness of the breast portion of the front bodice portion and those indicated at 92*b* are for flattening the narrow waist portion of the back bodice portion 90*b*. As can be understood from the part shown by the thick lines in FIG. 19, the tenth predetermined shape according to the tenth embodiment is deployed by cutting the sleeve portions in a spiral elongated shape and the front and back bodice portions 90*a*, 90*b* along the side lines 94*a* and the front bodice portion 90*a* along a front center line 94*b*.

Then, the tenth entirely deployed pattern 90 is observed to determine how it should be divided, i.e., shapes of pattern pieces. Since the tenth entirely deployed pattern 90 has an elongated shape for the sleeve portions 90*c* and substantially square shapes for the front and back bodice portions. Therefore, it can be divided into elongated areas extending from the sleeve portions 90*c* and the side portions of the front and the back bodice portions. Further, each of the elongated areas is divided into a broad elongated area and a narrow elongated area as shown in FIG. 19. Furthermore, the rest of the front bodice portion 90*a* and the back bodice portion 90*b* are divided into vertical elongated areas, each of which is also divided into a broad elongated area and a narrow elongated area. Based on the pattern pieces, long elongated shape of the knitted pieces can be simply created.

Subsequently, the broad elongated shape and narrow elongated shape of knitted pieces are created out of yarns of different colors based on each of the pattern pieces. Then, the sleeve portions 90*c* of the knitted pieces are folded along one-dot chain lines to be rolled up into a spiral form in which aligned edges are connected to each other. Further, the front and back portions are joined in accordance with the arrangement of the tenth entirely deployed pattern 90 in FIG. 19, the long sleeve sweater 94 with broad and narrow vertical stripes of an ornamental design as shown in FIG. 20 can be obtained.

Figure 21:
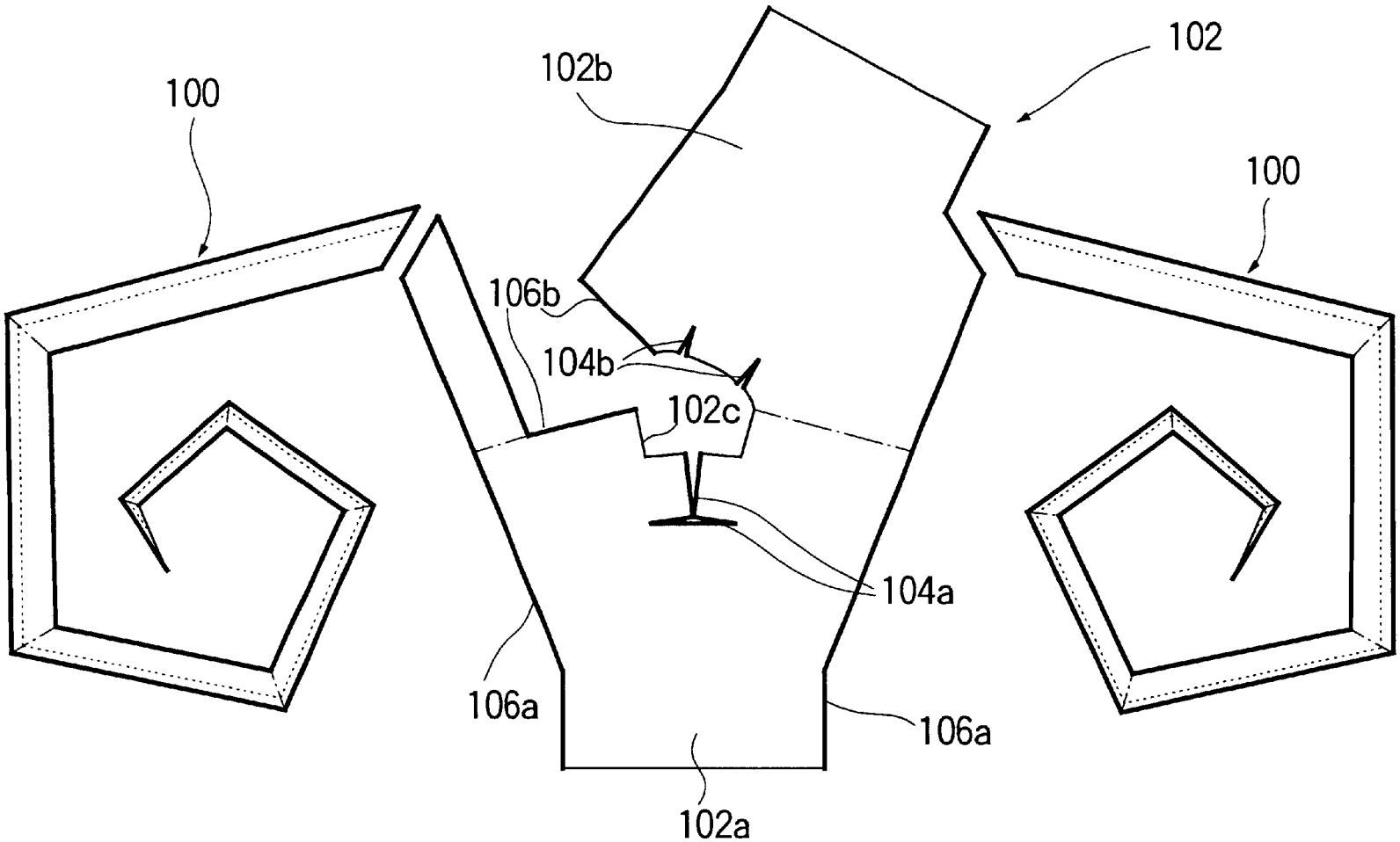
FIG. 21 shows an eleventh entirely deployed pattern and pattern pieces thereof in accordance with an eleventh embodiment.
Figure 22:
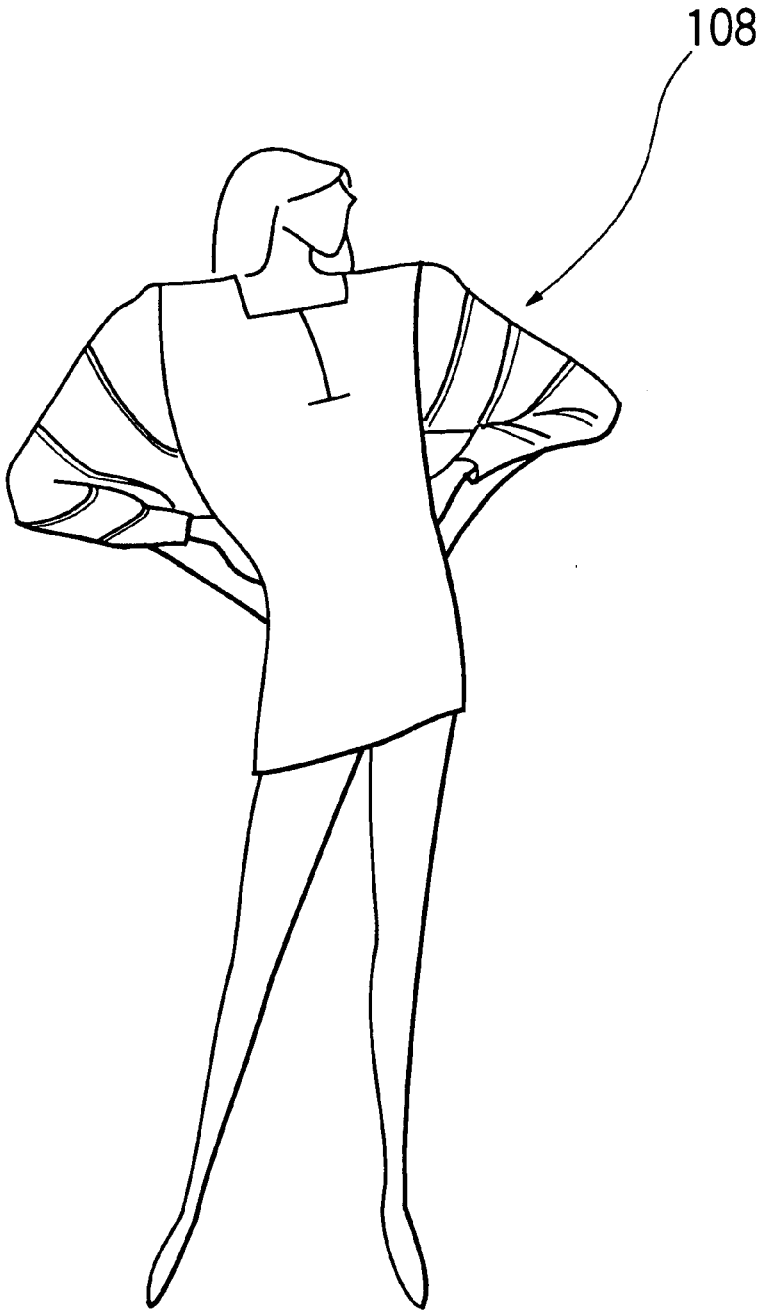
FIG. 22 shows an eleventh sweater knitted according to the eleventh entirely deployed pattern shown in FIG. 21.

FIG. 21 shows an eleventh entirely deployed pattern and pattern pieces thereof in accordance with an eleventh embodiment. FIG. 22 shows an eleventh sweater knitted according to the eleventh entirely deployed pattern shown in FIG. 21.

In the eleventh embodiment, it is predetermined to create a collarless long sleeve sweater including a front bodice portion, a back bodice portion, and long sleeve portions. More specifically, an eleventh predetermined design has a square neckline and a narrow waist line, and substantially conical shape of loose sleeves extending from wide armhole portions to narrow cuff portions.

As shown in FIG. 21, in this embodiment, there are three separate deployed patterns, i.e., a bodice portion deployed pattern 102 which is a deployed pattern of the front and back bodice portions and two sleeve deployed patterns 100, each of which being shown by solid lines in FIG. 21. Explaining details of the front and back bodice portions deployed pattern 102, the front bodice portion is indicated at 102*a*, the back bodice portion at 102*b*, and the square neckline at 102*c*. Further, clippings indicated at 104*a* are for flattening the fullness of the breast portion of the front bodice portion and those indicated at 104*b* are for flattening the round portion of the back bodice portion 102*b*. As can be understood from the part shown by the thick lines in FIG. 21, the eleventh predetermined shape according to the eleventh embodiment are deployed by cutting the sleeve portions were in a spiral elongated shape and the front and back bodice portions 102*a*, 102*b* along the side lines 106*a* and the right shoulder line 106*b*.

In this embodiment, each of the sleeve deployed patterns 100 define may consist of one elongated divided pattern. Further, each of the elongated divided patterns is subdivided into broad and narrow elongated areas. Further, the front and the back bodice portions 102*a*, 102*b* consist one divided area without being subdivided into divided areas. Based on the pattern pieces, the knitted pieces can be simply created.

Subsequently, the broad elongated shape and narrow elongated shape of knitted pieces are created out of yarns of different colors based on each of the pattern pieces and they are joined to each other in an elongated direction. The sleeve portions 100 are folded along one-dot chain lines to be rolled up into a spiral shape in which aligned edges are connected to each other. Further, one integral knitted piece is created for the front and back portions 102*a*, 102*b* and the side lines and the shoulder lines are joined to each other. Furthermore, the sleeve portions and the front and back bodice portions are joined to each other to obtain the long sleeve sweater 108 with broad and narrow lateral stripes of an ornamental design as shown in FIG. 22.

Figure 23:
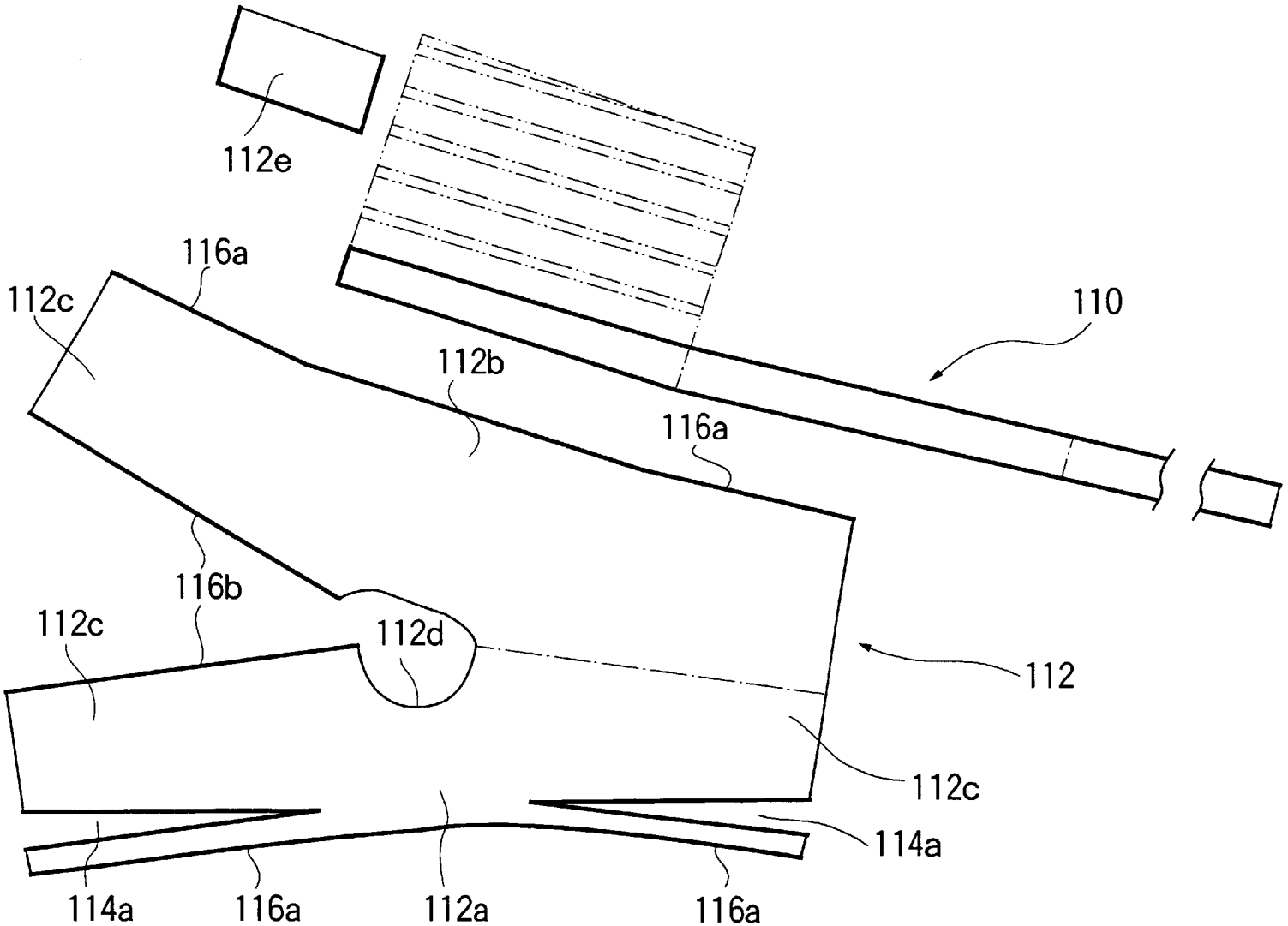
FIG. 23 shows a twelfth entirely deployed pattern and pattern pieces thereof in accordance with a twelfth embodiment.
Figure 24:
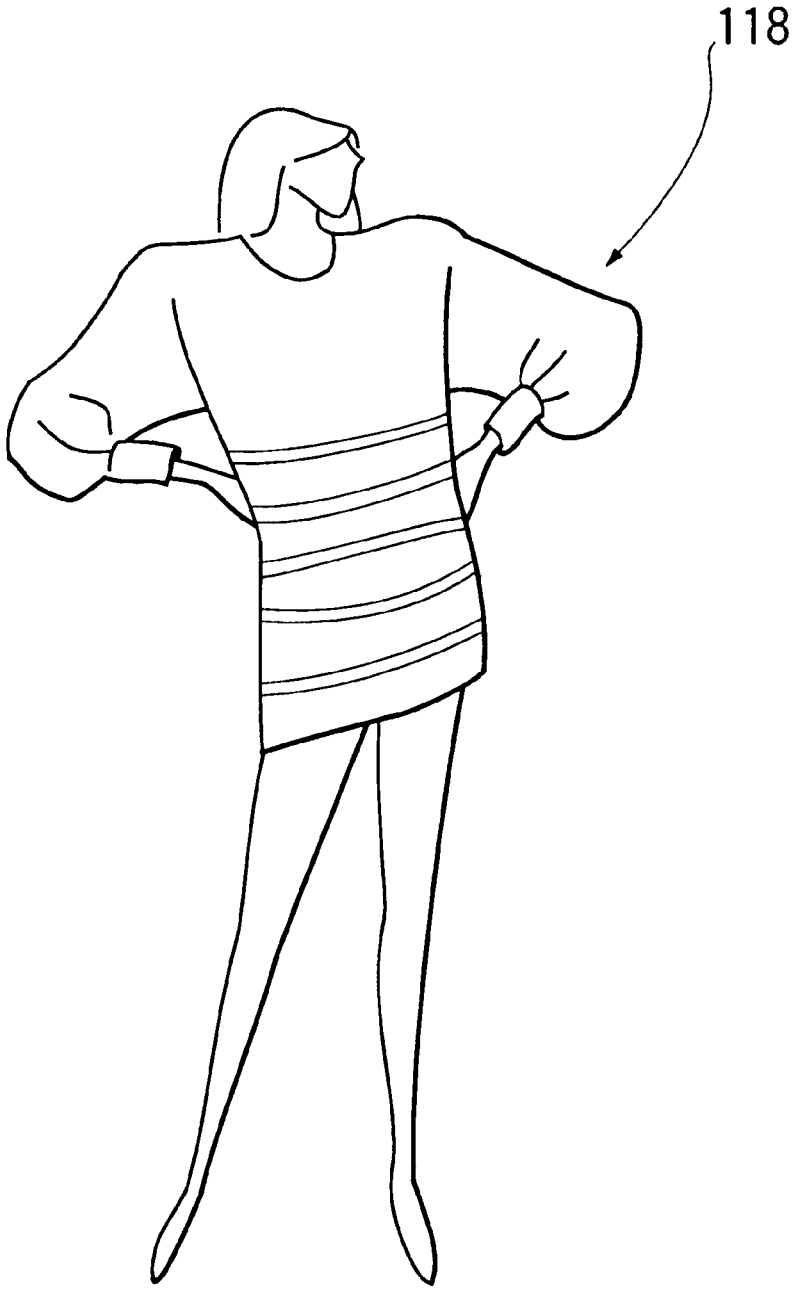
FIG. 24 shows a twelfth sweater knitted according to the twelfth entirely deployed pattern shown in FIG. 23.

FIG. 23 shows a twelfth entirely deployed pattern and pattern pieces thereof in accordance with a twelfth embodiment. FIG. 24 shows a twelfth sweater knitted according to the twelfth entirely deployed pattern shown in FIG. 23.

In the twelfth embodiment, it is predetermined to create a collarless long sleeve sweater including a front bodice portion, a back bodice portion, and long sleeve portions. More specifically, a twelfth predetermined design has a round neckline and a cylindrical waist portion with straight side lines, and straight sleeves.

As shown in FIG. 23, in this embodiment, there are three separate deployed patterns, i.e., an upper half bodice deployed pattern 112 which is a deployed pattern of the upper half bodice portion, a waist portion deployed pattern 110 and a cuff deployed pattern 112*e*, each of which being shown by solid lines in FIG. 23. Explaining details of the upper half bodice deployed pattern 112, the breast portion of the front bodice portion is indicated at 112*a*, the back portion of the back bodice portion at 112*b*, sleeve portions at 112*c* and the round neckline at 112*d*. Further, clippings indicated at 114*a* are for flattening round elbow portions of the sleeve portions. As can be understood from the part shown by the thick lines in FIG. 23, the twelfth predetermined shape according to the twelfth embodiment are deployed by cutting the waist portion in a spiral elongated shape and the upper half bodice portion along the under sleeve lines 116*a* and the right upper sleeve line 116*b*.

The waist deployed pattern 110 can define one elongated areas and it can be subdivided into broad and narrow elongated areas. Further, the upper half bodice portion consist one area without divided into the divided areas. Based on the pattern pieces, the knitted pieces can be simply created.

Subsequently, the broad elongated shape and narrow elongated shape of knitted pieces are created out of yarns of different colors based on each of the pattern pieces and they are joined to each other in an elongated direction. The knitted piece of the waist portion 110 is folded along one-dot chain lines to be rolled up into a spiral form in which aligned edges are connected to each other to form the waist portion. Further, one knitted piece for the upper half bodice portion is knitted separately based on the upper half bodice deployed pattern 112. Then, the under sleeve lines and the upper sleeve line are joined to each other. Further, the waist portion and the upper half bodice portion are joined to each other to obtain the long sleeve sweater 118 with broad and narrow lateral stripes of an ornamental design as shown in FIG. 24.

The present invention has thus been shown and described with reference to specific embodiments. However, it should be noted that the present invention is in no way limited to the details of the described arrangements but changes and modifications may be made without departing from the scope of the appended claims.

For example, in the first through tenth embodiments, although each of the entirely deployed patterns has a shape obtained by flattening the entire predetermined shape. However, in the case where the predetermined design has a symmetrical shape as in the second, third, fifth and tenth embodiments, a deployed pattern only for either right or left half of the design may be formed. The right or left half deployed pattern can be further divided into pattern pieces. Based on the deployed pattern, a pair of knitted pieces in mirror symmetry are created and are joined to each other to form a sweater.

Furthermore, in the fourth embodiment, although the entirely deployed pattern consists of one piece of pattern, the deployed pattern shown in FIG. 7 can be divided into two deployed patterns, i.e., a front and back deployed patterns which are separated along the one-dot chain line along the left upper sleeve line.

Furthermore, in the first through twelfth embodiments, the deployed patterns are divided into the elongated or rectangular areas. However, the shapes of the divided areas can be any shapes based on which a knitter can easily create the knitted pieces, for example, polygon, triangle, or the like.

Furthermore, in the first through twelfth embodiments, the plurality of the pattern pieces are depicted within the entirely deployed patterns. However, each of the pattern pieces can be individually separated and may be formed out of a material such as paper, cardboard, or the like.

Furthermore, in the first through twelfth embodiments, the entirely deployed patterns and the pattern pieces are made out of paper, cardboard, or the like, the outlines thereof may be printed on a sheet of paper or cardboard.

Furthermore, in the first through twelfth embodiments, knitting operation of a sweater has been explained. However, the present invention can also be applied for knitting any other garments including dresses, pants, jackets, or the like.

The present invention enables to form three-dimensional knitted garments which fit to profile of the body. Further, the present invention provides a knitting method which enables to easily knit the three-dimensional knitted garments even for beginners.

What is claimed is:

1. A method for creating knitted garments, comprising:

forming a pattern having a shape which corresponds to an entire flattened three-dimensional design of a garment to be knitted;

dividing said pattern into a plurality of divided areas, wherein at least one clipping or dart is provided between one divided area and an adjacent divided area, each of said divided areas defining a pattern piece;

creating knitted pieces which conform to each shape of said pattern piece; and forming said garment by joining said knitted pieces to each other based on an arrangement of said divided areas.

2. A method for creating knitted garments as recited in claim 1, wherein said dividing said pattern includes by dividing at least a portion of said pattern into elongated areas to form a plurality of elongated pattern pieces.

3. A method for creating knitted garments as recited in claim 2, wherein said dividing at least a portion of said pattern into elongated areas includes forming a plurality of elongated pattern pieces having an arcuate elongated shape.

4. A method for creating knitted garments as recited in claim 1, wherein said dividing said pattern including dividing at least a portion of said pattern into substantially rectangular areas to form a plurality of rectangular pattern pieces.

5. A method for creating knitted garments as recited in claim 1, wherein said forming a pattern includes arranging said three-dimensional design into a substantially elongated shape including a front body portion and a back body portion, and said dividing said pattern includes dividing said elongated pattern into a plurality of elongated divided areas in an elongated direction thereof to form elongated pattern pieces.

6. A method for creating knitted garments as recited in claim 1, wherein said forming a pattern includes arranging said three-dimensional design into a substantially elongated shape including a front body portion, sleeve portions and a back body portion to form an elongated entirely deployed pattern, and said dividing said pattern includes dividing said elongated entirely deployed pattern into a plurality of elongated divided areas in an elongated direction thereof to form elongated pattern pieces.

7. A method for creating knitted garments as recited in claim 1, wherein said forming step of said entirely deployed pattern is carried out by deploying at least a part of said entire predetermined three-dimensional design into a spiral elongated shape to form a spiral deployed pattern; and said spiral deployed pattern being further divided into divided areas to form pattern pieces.

8. A method for creating knitted garments, comprising:

forming a spiral pattern, having a shape which corresponds to at least a part of a flattened three-dimensional design of a garment to be knitted, into a spiral shape;

creating knitted pieces which conform to the shape of said spiral deployed pattern; and forming said at least a part of said three-dimensional design of the garment by rolling up said pattern into a spiral form such that aligned edges are adjacent to each other.

9. A pattern for creating knitted garments, comprising:

a pattern having an outline shape which corresponds to an entire flattened three-dimensional design of a garment to be knitted, said outline shape including shapes of a plurality of divided areas, wherein at least one clipping or dart being provided in between one divided area and an adjacent divided area of said pattern.

10. A half body pattern for creating knitted garments, comprising:

a pattern having an outline shape which is obtained by flattening either one of a left half and a right half of an entire predetermined three-dimensional and symmetrical design of a garment to be knitted, said outline shape including shapes of a plurality of divided areas, at least one clipping or dart being provided in between one divided area and an adjacent divided area of said pattern.

11. A pattern for creating knitted garments comprising:

pattern pieces formed by dividing said pattern into a plurality of divided areas, at least one clipping or dart being provided in between one divided area and an adjacent divided area of said pattern.

12. A half body pattern for creating knitted garments comprising:

pattern pieces formed by dividing said half body pattern into a plurality of divided areas, at least one clipping or dart being provided in between one divided area and an adjacent divided area of said pattern.

13. A pattern for creating sleeve portions of knitted garments comprising a sleeve portion pattern having an elongated shape which is obtained by flattening into a spiral shape a sleeve portion of an entire predetermined three-dimensional design of a garment to be knitted.

14. A pattern for creating knitted garments comprising a waist pattern having an elongated shape which is obtained by flattening into a spiral shape a waist portion of an entire predetermined three-dimensional design of a garment to be knitted.

15. A pattern according to any one of claims 9–12, wherein said pattern pieces have a shape corresponding to the shape of said divided areas.

16. A deployed pattern for creating knitted garments being printed on a sheet, said sheet comprising a printed shape of the pattern as recited in any one of claims 9 through 14.

17. A pattern according to claim 15, wherein said pattern pieces are printed on a sheet of paper or cardboard.

18. A knitted garment formed by the method as recited in any one of claims 1 through 8.

19. A method for creating knitted garments, comprising:

forming a half body pattern having a shape which corresponds to a flattened one of either of a left half or right half of an entire three-dimensional and symmetrical design of a garment to be knitted;

dividing said half body pattern into a plurality of divided areas to form pattern pieces, wherein at least one clipping or dart is provided in between one divided area and an adjacent divided area of said pattern;

creating knitted pieces which conform to each shape of said pattern pieces; and forming said predetermined design of said garment by joining said knitted pieces to each other based on an arrangement of said divided areas.

* * * * *

UNITED STATES PATENT AND TRADEMARK OFFICE

CERTIFICATE OF CORRECTION

PATENT NO. : 6,250,115 B1
DATED : June 26, 2001
INVENTOR(S) : Suzuki

It is certified that error appears in the above-identified patent and that said Letters Patent is hereby corrected as shown below:

Column 14,
Line 31, please delete “at least” and
Line 32, after “between” insert -- at least --

Column 15,
Line 31, after “wherein”, delete “at least” and
Line 32, after “between” insert -- at least --
Line 42, delete “at least “ and after “between” insert -- at least --

Column 16,
Line 1, delete “at least” and after “between” insert -- at least --
Line 8, delete “at least” and after “between” insert -- at least --
Line 37, after “wherein” delete “at least” and
Line 38, after “between” insert -- at least --

Signed and Sealed this

Twenty-sixth Day of November, 2002

*Attest:*

*Attesting Officer*

JAMES E. ROGAN
*Director of the United States Patent and Trademark Office*